US011267621B2

(12) United States Patent
Guerdrum et al.

(10) Patent No.: US 11,267,621 B2
(45) Date of Patent: Mar. 8, 2022

(54) STORAGE CONTAINER AND FLOATING LATCH

(71) Applicant: Otter Products, LLC, Fort Collins, CO (US)

(72) Inventors: Jonathan H. Guerdrum, Fort Collins, CO (US); Marina Okada, San Diego, CA (US); Joseph A. Prizzi, Vista, CA (US); Jason Sagen, Fort Collins, CO (US); Joshua R. Cornish, Fort Collins, CO (US); Peter Goldsmith, Fort Collins, CO (US)

(73) Assignee: Otter Products, LLC, Fort Collins, CO (US)

( * ) Notice: Subject to any disclaimer, the term of this patent is extended or adjusted under 35 U.S.C. 154(b) by 216 days.

(21) Appl. No.: 16/566,191

(22) Filed: Sep. 10, 2019

(65) Prior Publication Data

US 2020/0102126 A1 Apr. 2, 2020

Related U.S. Application Data

(60) Provisional application No. 62/737,231, filed on Sep. 27, 2018.

(51) Int. Cl.
*B65D 43/22* (2006.01)
*B65D 45/16* (2006.01)
(Continued)

(52) U.S. Cl.
CPC ..... *B65D 43/22* (2013.01); *B65D 43/16* (2013.01); *B65D 45/16* (2013.01); *B65D 81/3813* (2013.01)

(58) Field of Classification Search
CPC ..... B65D 43/22; B65D 43/16; B65D 45/16; B65D 81/3813; B65D 55/06; F25D 3/08;
(Continued)

(56) References Cited

U.S. PATENT DOCUMENTS 1,468,563 A 9/1923 Girard
2,496,296 A 2/1950 Frederick
(Continued)

FOREIGN PATENT DOCUMENTS

EP 3061704 A1 8/2016
WO 2004029526 A1 4/2004
(Continued)

OTHER PUBLICATIONS amazon.com, "Farberware 5190590 3-piece cutting board set," dated Jul. 23, 2011, downloaded from https ://www.amazon.com/Farberware-5190590-3-Piece-Plastic-Assorted/dp/80731KDNM P/ref=cm_cr_arp_d_product_top?ie=UTF8 Mar. 11, 2019, 8 pages.
(Continued)

*Primary Examiner* — J. Gregory Pickett
*Assistant Examiner* — Brijesh V. Patel

(57) ABSTRACT

A storage container includes a base having an interior storage volume, a lid, and a latch configured to move between an unsecured position in which the lid is movable from the closed position and a secured position in which the lid is retained in the closed position. The latch is configured to extend through an aperture defined by the lid and the base. The latch includes an extended edge to prevent the latch from passing entirely through the aperture. The latch is captured by the lid and floats within the lid portion of the aperture. The latch also includes a resilient portion configured to engage an opening in the base portion of the aperture to selectively retain the lid and the body in the closed position when the latch is in the secured position. The latch is not permanently attached to the base or to the lid.

23 Claims, 16 Drawing Sheets

(51) Int. Cl.
*B65D 43/16* (2006.01)
*B65D 81/38* (2006.01)

(58) Field of Classification Search
CPC ... F25D 3/06; F25D 3/14; A45C 11/20; E05B 15/1635; E05B 1/0053; E05B 2015/165; E05B 2015/1678; E05B 65/52; E05B 65/5276; E05C 3/048
USPC ..... 220/592.2, 592.1, 315, 324, 529.03; 62/457.7, 331
See application file for complete search history.

(56) References Cited

U.S. PATENT DOCUMENTS 2,610,759 A 9/1952 Slade
2,627,993 A 2/1953 Hafner
2,632,311 A 3/1953 Sullivan
2,635,779 A 4/1953 Pfeiffer
3,200,983 A 8/1965 Walter
3,347,060 A 10/1967 Barkan
3,395,550 A 8/1968 Dungan
3,398,850 A 8/1968 John
3,401,535 A 9/1968 Palmer
3,605,431 A 9/1971 Carson
3,658,035 A 4/1972 Harris
3,675,808 A 7/1972 Brink
3,850,398 A 11/1974 Kantor
3,868,829 A 3/1975 Mann et al.
3,939,986 A 2/1976 Pierro
4,024,731 A 5/1977 Branscum
4,143,695 A 3/1979 Hoehn
4,213,310 A 7/1980 Buss
4,235,346 A 11/1980 Liggett
4,319,629 A 3/1982 Hotta
4,336,883 A 6/1982 Krug et al.
4,344,301 A 8/1982 Taylor
4,372,444 A 2/1983 Grand et al.
4,441,336 A 4/1984 Cannon
D275,822 S 10/1984 Gatland et al.
4,499,997 A 2/1985 Swingley, Jr.
4,499,998 A 2/1985 Carlson
4,509,587 A 4/1985 Clark et al.
4,515,421 A 5/1985 Steffes
4,529,092 A 7/1985 Swingley, Jr.
4,560,128 A 12/1985 Willeby et al.
4,577,773 A 3/1986 Bitel
4,606,461 A 8/1986 Bolton
D285,413 S 9/1986 Carlson
4,746,008 A * 5/1988 Heverly ..... B65D 55/02 206/1.5
4,759,467 A 7/1988 Byrne
RE32,740 E 8/1988 Steffes
4,819,793 A 4/1989 Willard et al.
4,841,661 A 6/1989 Moore
4,872,589 A 10/1989 Englehart et al.
4,923,077 A 5/1990 Iperen et al.
4,964,528 A 10/1990 Wagoner
4,988,216 A 1/1991 Lyman
5,050,766 A 9/1991 Groh
5,052,185 A 10/1991 Spahr
D325,323 S 4/1992 Kahl
5,103,884 A 4/1992 Roman
5,103,998 A 4/1992 Caro et al.
D327,427 S 6/1992 McCooey
D328,389 S 8/1992 Pardo
D330,488 S 10/1992 Daniels
5,181,612 A 1/1993 Liu
5,215,248 A 6/1993 Moser
5,285,656 A 2/1994 Peters
5,299,688 A 4/1994 McKay et al.
5,329,787 A 7/1994 Friday
5,353,946 A * 10/1994 Behrend ..... B65D 43/169 220/326
D353,082 S 12/1994 Keven
D354,419 S 1/1995 Kahl et al.
5,390,797 A 2/1995 Smalley et al.
5,403,095 A 4/1995 Melk
5,405,012 A 4/1995 Shindler et al.
5,427,446 A 6/1995 Glomski
5,447,041 A 9/1995 Piechota
5,493,874 A 2/1996 Landgrebe
5,509,279 A 4/1996 Brown et al.
5,522,239 A 6/1996 Schwartz et al.
5,562,228 A 10/1996 Ericson
5,605,056 A 2/1997 Brown et al.
5,622,276 A 4/1997 Simmons
5,669,233 A 9/1997 Cook et al.
D387,249 S 12/1997 Mogil
D391,121 S 2/1998 Melk
5,816,432 A 10/1998 Hammen et al.
5,845,515 A 12/1998 Nelson
5,850,915 A 12/1998 Tajima
5,857,778 A 1/1999 Ells
5,913,448 A 6/1999 Mann et al.
D419,297 S 1/2000 Richardson et al.
D419,767 S 2/2000 Richardson et al.
D419,768 S 2/2000 Richardson et al.
6,026,978 A 2/2000 Clegg et al.
6,039,202 A 3/2000 Olstad et al.
D425,761 S 5/2000 Philipson et al.
6,065,873 A 5/2000 Fowler
D435,196 S 12/2000 Gregor et al.
6,185,860 B1 2/2001 Thibodeaux
6,193,097 B1 2/2001 Perianes
D441,261 S 5/2001 Stein
6,226,844 B1 * 5/2001 Lerra ..... A44B 11/006 24/615
6,234,677 B1 5/2001 Mogil
6,244,458 B1 6/2001 Frysinger et al.
D444,683 S 7/2001 Corrion
6,276,579 B1 8/2001 DeLoach
6,295,830 B1 10/2001 Newman
6,318,114 B1 11/2001 Slaughter
D451,765 S 12/2001 Israel et al.
6,325,281 B1 12/2001 Grogan
6,328,179 B1 12/2001 Conrado et al.
6,336,342 B1 1/2002 Zeddies
D455,934 S 4/2002 Culp et al.
6,409,066 B1 6/2002 Schneider et al.
D465,134 S 11/2002 Joss
6,474,095 B1 11/2002 Chan
D469,012 S 1/2003 Lee
6,505,479 B2 1/2003 Defelice et al.
D472,384 S 4/2003 Richardson
6,582,124 B2 6/2003 Mogil
6,595,687 B2 7/2003 Godshaw et al.
6,736,309 B1 5/2004 Westerman et al.
6,751,963 B2 6/2004 Navedo et al.
6,782,711 B2 8/2004 Abfalter
D502,599 S 3/2005 Cabana et al.
6,895,778 B1 5/2005 Ackerman
6,966,450 B2 11/2005 Askew
D513,122 S 12/2005 Greene
D513,123 S 12/2005 Richardson et al.
D514,808 S 2/2006 Morine et al.
6,993,931 B1 2/2006 Hamilton
7,004,323 B1 2/2006 Symonds
D516,807 S 3/2006 Richardson et al.
D527,226 S 8/2006 Maldonado
D527,953 S 9/2006 Gal
7,140,507 B2 11/2006 Maldonado et al.
7,147,125 B1 12/2006 Slovak et al.
7,195,127 B2 3/2007 Hsu et al.
D543,030 S 5/2007 Schäfer
7,257,963 B2 8/2007 Mayer
D553,999 S 10/2007 Mason
7,296,433 B2 11/2007 Uihlein et al.
D558,599 S 1/2008 Tilman et al.
D569,902 S 5/2008 Chang et al.
7,389,608 B1 6/2008 MacKay
7,415,794 B1 8/2008 Thompson
7,422,143 B2 9/2008 Mayer
7,682,080 B2 3/2010 Mogil

(56) References Cited

U.S. PATENT DOCUMENTS

D623,075 S 9/2010 Blythe
D623,947 S 9/2010 Levy
7,791,003 B2 9/2010 Lockhart et al.
7,810,350 B2 10/2010 Shelton
7,900,816 B2 3/2011 Kastanek et al.
7,908,870 B2 3/2011 Williams et al.
D635,832 S 4/2011 Bergin
D637,044 S 5/2011 Davis
7,950,246 B1 5/2011 Mayer et al.
7,984,820 B2 7/2011 Dancyger
D643,629 S 8/2011 Sofy et al.
8,011,194 B2 9/2011 Dimmitt
8,043,004 B2 10/2011 Mogil
D649,587 S 11/2011 Nemeth et al.
8,061,159 B2 11/2011 Mogil et al.
8,061,547 B2 11/2011 Camp, Jr.
8,065,889 B1 11/2011 Silberman
D659,014 S 5/2012 Blythe
8,209,995 B2 7/2012 Kieling et al.
8,246,190 B2 8/2012 Boiteau et al.
8,317,046 B2 11/2012 Vanderberg et al.
8,365,944 B2 2/2013 Vanderberg et al.
8,403,162 B2 3/2013 Vanderberg et al.
8,418,874 B2 4/2013 Ahlgrim et al.
8,424,699 B2 4/2013 Vanderberg et al.
8,430,265 B2 4/2013 Vanderberg et al.
8,448,813 B2 5/2013 Vanderberg et al.
8,607,581 B2 12/2013 Williams et al.
D697,770 S 1/2014 Khuu
8,622,235 B2 1/2014 Suchecki
D699,119 S 2/2014 Fukuda et al.
D712,720 S 9/2014 Seiders
D712,721 S 9/2014 Seiders
D712,722 S 9/2014 Seiders
D712,723 S 9/2014 Seiders
D714,125 S 9/2014 Seiders
8,844,316 B1 9/2014 Ademola et al.
8,863,546 B2 10/2014 Oberweis
8,875,964 B1 11/2014 Vanderberg
8,910,819 B2 12/2014 Seiders
8,919,082 B1 12/2014 Cataldo
8,925,752 B2 1/2015 Smith
D722,474 S 2/2015 Seiders
D722,475 S 2/2015 Seiders
D726,816 S 4/2015 Ehrlich et al.
9,022,249 B2 5/2015 Ranade
D730,649 S 6/2015 Thomas
D732,348 S 6/2015 Seiders et al.
D732,349 S 6/2015 Seiders et al.
D732,350 S 6/2015 Seiders et al.
D732,899 S 6/2015 Seiders et al.
9,108,790 B2 8/2015 Daley
9,139,352 B2 9/2015 Seiders et al.
9,182,168 B2 11/2015 Hernandez et al.
9,187,232 B2 11/2015 Seiders
9,205,962 B2 12/2015 Holderby
D748,978 S 2/2016 Glass et al.
D752,347 S 3/2016 Seiders et al.
9,290,297 B2 3/2016 Overath
9,314,143 B2 4/2016 Bensussan et al.
9,316,428 B2 4/2016 Mech
D757,534 S 5/2016 Matsuura
9,389,010 B1 7/2016 Booker
9,408,445 B2 8/2016 Mogil et al.
9,433,200 B2 9/2016 Norman
9,446,847 B2 9/2016 Richardson et al.
9,500,400 B2 11/2016 Smith
9,540,138 B2 1/2017 Dubois et al.
D778,614 S 2/2017 Ananian et al.
9,834,342 B2 4/2017 Seiders
D785,334 S 5/2017 Holt et al.
D786,559 S 5/2017 Seiders et al.
D786,560 S 5/2017 Seiders et al.
D786,561 S 5/2017 Seiders et al.
D786,562 S 5/2017 Seiders et al.
D787,187 S 5/2017 Seiders et al.
D797,454 S 9/2017 Seiders et al.
D797,455 S 9/2017 Seiders et al.
9,751,682 B2 9/2017 Mayer et al.
D798,670 S 10/2017 Seiders et al.
D799,276 S 10/2017 Seiders et al.
D799,277 S 10/2017 Seiders et al.
D799,905 S 10/2017 Seiders et al.
D801,123 S 10/2017 Seiders et al.
9,796,517 B2 10/2017 Seiders et al.
D802,373 S 11/2017 Seiders et al.
D803,041 S 11/2017 Patterson
9,809,357 B2 * 11/2017 Arnold ..... B65D 43/22
D804,905 S 12/2017 Seiders et al.
D805,851 S 12/2017 Seiders et al.
9,920,977 B1 3/2018 Avila
9,981,778 B2 5/2018 Plattner
D820,646 S 6/2018 Yockey
D821,165 S 6/2018 Guerdrum et al.
D821,825 S 7/2018 Sullivan et al.
D823,064 S 7/2018 Eichinger et al.
D823,065 S 7/2018 Eichinger et al.
D823,066 S 7/2018 Eichinger et al.
10,029,842 B2 7/2018 Seiders et al.
D824,730 S 8/2018 Guerdrum et al.
10,046,900 B2 8/2018 Seiders
D828,029 S 9/2018 Seiders et al.
10,092,137 B1 10/2018 Nelson et al.
D835,470 S 12/2018 Seiders et al.
D835,471 S 12/2018 Seiders et al.
D835,472 S 12/2018 Seiders et al.
D835,946 S 12/2018 Seiders et al.
D838,983 S 1/2019 Seiders et al.
D838,984 S 1/2019 Seiders et al.
D840,150 S 2/2019 Seiders et al.
10,221,005 B2 3/2019 James, Jr.
D845,717 S 4/2019 Cavenagh et al.
D850,865 S 6/2019 Smith et al.
10,351,330 B2 7/2019 Smith et al.
D856,673 S 8/2019 Stirnimann et al.
10,392,180 B1 8/2019 Travis et al.
10,443,918 B2 10/2019 Li et al.
10,676,235 B1 6/2020 Song et al.
10,676,267 B2 6/2020 Seiders et al.
D908,357 S * 1/2021 Guerdrum ..... B65D 43/22
D3/294
D912,400 S * 3/2021 Guerdrum ..... B65D 43/169
D3/294
2003/0038138 A1 2/2003 Komurke
2003/0106895 A1 6/2003 Kalal
2003/0136702 A1 7/2003 Redzisz et al.
2003/0141424 A1 7/2003 Thomas
2004/0143944 A1 * 7/2004 Huang ..... B65D 43/22
24/457
2004/0178208 A1 9/2004 Leba et al.
2004/0238543 A1 12/2004 Askew
2004/0262319 A1 12/2004 Fisher
2005/0006268 A1 1/2005 Futernick
2005/0133557 A1 6/2005 McKenzie et al.
2005/0263527 A1 12/2005 Maldonado et al.
2005/0263528 A1 12/2005 Maldonado et al.
2005/0279123 A1 12/2005 Maldonado et al.
2005/0279124 A1 12/2005 Maldonado
2005/0279666 A1 12/2005 Deng et al.
2005/0281487 A1 12/2005 Pawloski et al.
2006/0065655 A1 3/2006 Taylor
2006/0169658 A1 8/2006 Lim et al.
2006/0180624 A1 8/2006 Sadow et al.
2007/0028642 A1 2/2007 Glade et al.
2007/0137958 A1 6/2007 Hamlin
2007/0186579 A1 8/2007 Barker
2007/0278234 A1 12/2007 Mogil
2008/0094853 A1 4/2008 Kim et al.
2008/0121630 A1 5/2008 Simard
2008/0128428 A1 6/2008 Beckerman
2008/0257918 A1 10/2008 Vogel et al.
2008/0260303 A1 10/2008 Lesseux et al.
2008/0296194 A1 12/2008 Stahl
2008/0307824 A1 12/2008 Botich

(56) References Cited

U.S. PATENT DOCUMENTS

| | | | |
|---|---|---|---|
| 2009/0052809 | A1 | 2/2009 | Sampson |
| 2009/0078709 | A1 | 3/2009 | Murrer, III |
| 2009/0159471 | A1 | 6/2009 | Koppe |
| 2009/0218342 | A1 | 9/2009 | Pickles |
| 2009/0261111 | A1 | 10/2009 | Hsu |
| 2010/0001018 | A1 | 1/2010 | Puma |
| 2010/0065466 | A1 | 3/2010 | Perkins |
| 2010/0072215 | A1 | 3/2010 | Coon |
| 2010/0287976 | A1 | 11/2010 | Roof et al. |
| 2011/0056233 | A1 | 3/2011 | Flaker et al. |
| 2011/0182532 | A1 | 7/2011 | Baltus |
| 2011/0203297 | A1 | 8/2011 | Oberweis |
| 2011/0220531 | A1 | 9/2011 | Meether et al. |
| 2011/0289958 | A1 | 12/2011 | White et al. |
| 2011/0290792 | A1 | 12/2011 | Krzak et al. |
| 2012/0043289 | A1 | 2/2012 | Brown et al. |
| 2013/0200083 | A1 | 8/2013 | Cunningham |
| 2013/0228583 | A1 | 9/2013 | Mayer |
| 2013/0264161 | A1 | 10/2013 | Thompson |
| 2014/0013789 | A1 | 1/2014 | Conrad et al. |
| 2014/0054195 | A1 | 2/2014 | Hallman |
| 2014/0124406 | A1 | 5/2014 | Ishikawa et al. |
| 2014/0131225 | A1 | 5/2014 | Couch, III et al. |
| 2014/0248003 | A1 | 9/2014 | Mogil et al. |
| 2015/0068242 | A1 | 3/2015 | Patstone |
| 2015/0158539 | A1 | 6/2015 | Jensen et al. |
| 2015/0175338 | A1 | 6/2015 | Culp et al. |
| 2015/0210444 | A1 | 7/2015 | Mercado et al. |
| 2015/0241107 | A1 | 8/2015 | Mech |
| 2015/0298886 | A1 | 10/2015 | Knight et al. |
| 2015/0369529 | A1 | 12/2015 | Monroe |
| 2016/0023837 | A1 | 1/2016 | Furneaux et al. |
| 2016/0059990 | A1 | 3/2016 | Patikas-Bryant |
| 2016/0101924 | A1 | 4/2016 | Mitchell et al. |
| 2016/0176577 | A1 | 6/2016 | Frankenberg et al. |
| 2016/0257471 | A1 | 9/2016 | Rud |
| 2016/0257479 | A1 | 9/2016 | Seiders et al. |
| 2016/0279840 | A1 | 9/2016 | French et al. |
| 2016/0347507 | A1 | 12/2016 | Kendrick |
| 2016/0355319 | A1 | 12/2016 | Stephens |
| 2017/0001785 | A1 | 1/2017 | Ripley et al. |
| 2017/0023289 | A1 | 1/2017 | Anderson |
| 2017/0073146 | A1 | 3/2017 | Kuhn et al. |
| 2017/0073147 | A1 | 3/2017 | Kuhn |
| 2017/0115046 | A1 | 4/2017 | Blezard et al. |
| 2017/0121059 | A1 | 5/2017 | Faris |
| 2017/0233139 | A1 | 8/2017 | Averill |
| 2017/0245486 | A1 | 8/2017 | Larson et al. |
| 2017/0305639 | A1 | 10/2017 | Kuhn et al. |
| 2017/0314836 | A1 | 11/2017 | Donnell et al. |
| 2017/0350635 | A1 | 12/2017 | Thirumurugavel |
| 2018/0009101 | A1 | 1/2018 | Piccininni et al. |
| 2018/0015938 | A1 | 1/2018 | DeFrancia |
| 2018/0016060 | A1 | 1/2018 | Peach et al. |
| 2018/0141718 | A1 | 5/2018 | Ahlström et al. |
| 2018/0141739 | A1 | 5/2018 | Hengen |
| 2018/0149400 | A1 | 5/2018 | Valencia |
| 2018/0184775 | A1 | 7/2018 | Altschul et al. |
| 2018/0186547 | A1 | 7/2018 | Morine et al. |
| 2018/0186550 | A1 | 7/2018 | Morine et al. |
| 2018/0187962 | A1 | 7/2018 | Stollenwerck, III |
| 2018/0202700 | A1 | 7/2018 | Ansted et al. |
| 2018/0263346 | A1 | 9/2018 | Stephens |
| 2018/0290814 | A1 | 10/2018 | Smith |
| 2018/0335241 | A1 | 11/2018 | Li et al. |
| 2018/0346229 | A1 | 12/2018 | Guerdrum et al. |
| 2018/0353379 | A1 | 12/2018 | Chou et al. |
| 2018/0360178 | A1 | 12/2018 | Bungert |
| 2019/0023480 | A1 | 1/2019 | Lin |
| 2019/0092554 | A1 | 3/2019 | Rogers et al. |
| 2019/0144164 | A1 | 5/2019 | Breyburg |
| 2020/0102126 | A1 | 4/2020 | Guerdrum et al. |
| 2020/0109889 | A1* | 4/2020 | Kieling ..... B65D 25/2882 |
| 2020/0165055 | A1 | 5/2020 | Barfoot et al. |
| 2020/0189794 | A1* | 6/2020 | Pefley ..... F16B 2/10 |
| 2021/0016955 | A1* | 1/2021 | Morine ..... B65D 55/02 |

FOREIGN PATENT DOCUMENTS

| | | | |
|---|---|---|---|
| WO | 2006007266 | A2 | 1/2006 |
| WO | 2006009537 | A1 | 1/2006 |
| WO | 2014105962 | A1 | 7/2014 |
| WO | 2016154105 | A1 | 9/2016 |

OTHER PUBLICATIONS

Best Buy, "OtterBox Separator for Venture Coolers—Slate Gray," downloaded from https://www.bestbuy.com/site/otterbox-separator-for-venture-coolers-slate-gray/5824901.p?sku Id=5824901 Nov. 4, 2018, 5 pages.

Best Cooler Reviews, Best Folding and Collapsible Cooler—It's All About Convenience, downloaded from https://bestcooler.reviews/best-folding-collapsible-cooler/ Jan. 15, 2018, 8 pages.

Clevermade, CleverMade CleverCrates 45 Liter Collapsible Storage Bin/Container; Grated Wall Utility Basket/Tote, Royal Blue, downloaded from https://www.amazon.com/CleverMade-CleverCrates-Collapsible-Storage-Container/dp/B00UM4D63W/ref=sr_1_8?ie=UTF8&qid=1516048768&sr=8-8&keywords=collapsible%2Bmilk%2Bcrate&th=1 Jan. 15, 2018, 13 pages.

Coleman, 75 Can Collapsible Sport Cooler, downloaded from https://www.coleman.com/large-sport-collapsible/2000015225.html Jan. 15, 2018, 3 pages.

Digital Trends, "The new Venture coolers from Otterbox . . . ", Posted May 9, 2017.(https://www.digitaltrends.com/outdoors/otterbox-venture-coolers/).

Duluth Trading Co, Folding Milk Crate, downloaded from https://www.duluthtrading.com/store/product/folding-milk-crate-78536.aspx on Jan. 15, 2018, 6 pages.

Fulton, Wil, All the Major Meal Delivery Services, Tested and Ranked, dated Oct. 7, 2016, downloaded from https://www.thrillist.com/eat/nation/best-meal-delivery-services-food-subscription-boxes-ranked on Jan. 15, 2018, 18 pages.

Ice Chest Guide, "Top 10 Best Soft Cooler Reviews and Buying Guide for 2018", downloaded from http://www.icechestguide.com/top-10-best-soft-cooler-reviews-and-buying-guide.html Jan. 25, 2018, 12 pages.

Igloo, Marine Ultra TM Collapse and Cool TM 50, downloaded from https://www.igloocoolers.com/products/61582-marine-ultra-collapse-and-cool-50-can-cooler-bag-white Jan. 15, 2018, 4 pages.

Kelty Folding Cooler, downloaded from https://www.kelty.com/folding-cooler/ Jan. 18, 2018, 6 pages.

Morris, David Z., This box opens up new possibilities for fresh food delivery, dated Aug. 3, 2015, downloaded from http://fortune.com/2015/08/03/freshrealm-cold-delivery/ Jan. 15, 2018, 4 pages.

NRS, "NRS Big Sky Cooler Divider at nrs.com," downloaded from https://www.nrs.com/product/4450/nrs-big-sky-cooler-divider Nov. 4, 2018, 4 pages.

Otterbox, "Cooler Divider OtterBox Venture Cooler Accessory," downloaded from www.otterbox.com/en-us/venture/separator/otr56-cooler-acc-separator. html#start= 1 Nov. 4, 2018, 4 pages.

Otterbox, "Rugged Venture Coolers", Accessed Jan. 16, 2018. (https://www.otterbox.com/en-us/venture-coolers.html).

Pelican Consumer, Coolers—Hunting, Fishing, Camping, downloaded from http://www.pelican.com/us/en/products/coolers May 8, 2017, 2 pages.

Pelican Products, "70QT Cooler", Accessed Jan. 16, 2018. (http://www.pelican.com/us/en/product/outdoor-heavy-dutycoolers/elite-cooler/cooler/70QT/).

Picnic at Ascot, 396-RB 60 Can Collapsible Rolling Cooler, downloaded from http://www.picnicatascot.com/main/default/ProductsDetail.aspx?id=136 Jan. 15, 2018, 2 pages.

Polar Bear Coolers, "24 Pack Eclipse Cooler," downloaded from http://www.polarbearcoolers.com/product/PB327.html Jan. 30, 2018, 6 pages.

(56) References Cited

OTHER PUBLICATIONS

Polar Bear Coolers, "Eclipse Backpack Cooler," downloaded from http://www.polarbearcoolers.com/product/PB397.html Jan. 29, 2018, 4 pages.
REI Co-Op, "Soft-sided Coolers", downloaded from https://www.rei.com/c/soft-sided-coolers?r-c&origin+web&ir=category%3Asoft-sided-coolers%page=1 Jan. 25, 2018, 6 pages.
RTIC, "RTIC Soft Pack Coolers," downloaded form https://www.rticcoolers.com/shop/coolers/softpak Jan. 25, 2018, 16 pages.
RTIC, Cooler Accessories, downloaded May 8, 2017 from http://www.rticcoolers.com/shop/coolers/accessories, 14 pages.
Stay Cool Hot Stuff, Flip-Box XL Collapsible Cooler and Insulation Box, downloaded from https://staycoolhotstuff.com/products/flip-box-xl-collapsible-cooler-and-insulation-box Jan. 18, 2018, 5 pages.
The Cooler Box, "Cordova Coolers vs Yeti—Is This New Cooler Better Than Yeti?", Published Oct. 24, 2016.(http://thecoolerbox.com/cordova-coolers-vs-yeti/).
The Good Housekeeping Institute, Thermos Cold N' Fold Cooler, dated Jul. 2007, downloaded from http://www.goodhousekeeping.com/travel-products/food-cooler-reviews/a28866/thermos-cold-n-fold-cooler-101/ Jan. 18, 2018, 5 pages.
Walmart, ECR4Kids Large Vented Collapsible Crate, 12pk, downloaded from https://www.walmart.com/ip/ECR4Kids-Large-Vented-Collapsible-Crate-12pk/34702630 on Jan. 15, 2018, 7 pages.
YETI Coolers, "Hopper Soft Sided Portable Coolers," downloaded from https://www.yeti.com/soft-coolers Jan. 25, 2018, 6 pages.
YETI Coolers, "Tundra Cooler Divider," dated Mar. 11, 2014, downloaded from https://www.yeti.com/en_US/accessories/tundra-dividers/DV.html?cg id =accessories# Mar. 11, 2019, 9 pages.
YETI Coolers, Tundra Cooler Divider, downloaded from www.yeti.com/tundra-dividers May 8, 2017, 4 pages.
YETI Coolers, Tundra Ice Chests, downloaded from http://yeti.com/tundra May 8, 2017, 7 pages.
YETI Coolers, YETI Accessories & Parts, downloaded from http://yeti.com/accessories May 8, 2017, 5 pages.

* cited by examiner

STORAGE CONTAINER AND FLOATING LATCH

CROSS REFERENCE TO RELATED APPLICATIONS

The present application claims priority to U.S. Provisional Patent Application No. 62/737,231, filed Sep. 27, 2018, which is hereby incorporated by reference in its entirety.

FIELD

This disclosure relates generally to a latch for securing a lid of a container for storing objects.

BACKGROUND

It is often desirable to store objects in a container having a removably attachable lid. These containers may be intended for stationary use, or they may be intended to be portable. Portable storage containers, including insulated and non-insulated storage containers, coolers, and/or insulated shipping containers, may also be used for a variety of other purposes or activities including: travel, hunting, fishing, camping, medical purposes, general storage, grocery delivery, meal kit shipping, other food delivery, and/or other business or personal purposes. Exemplary storage containers are disclosed in U.S. patent application Ser. Nos. 15/398,468; 15/455,273; 15/494,020; 15/982,059; and 15/982,246, the disclosures of each of which are hereby incorporated in their entirety.

A container may include a latching mechanism to secure the removably attachable lid to a base of the container. In some situations, it is desirable that the latching mechanism secure the lid in place despite various forces being placed on the container, such as from stacking additional items on or around the container, or from dropping the container. In addition, in some situations it is desirable for an operator to be able to engage and/or release a latching mechanism holding the lid to the base with only one hand. In addition, in some situations it may be desirable for the latching mechanism securing the lid to the base of the container have a relatively small profile to allow efficient stacking and transport of the containers. In addition, in some situations it may be desirable for the latching mechanism to be fully removable for cleaning or replacement, but not removable in the ordinary open and closing of the container in order to prevent loss or misplacement of the latch.

Improvements in one or more of the foregoing are desired.

SUMMARY

Storage containers are used for a variety of purposes and in conjunction with a variety of activities. In some exemplary embodiments, the storage container may be insulated to assist in keeping one or more items cool, cold, frozen, warm, or hot. The storage container may also be used to protect one or more items from damage, bumps, scratching, impact, water, rain, snow, mud, dust, dirt, light, visibility, theft, chemicals, and/or contaminants. The storage container may also be used to organize and/or transport items stored therein. In some situations, the storage container may be reused many times. In some situations, the storage container may be returned to the original shipper by the end customer and the storage container may be empty. While most of the examples discussed herein are presented with respect to a portable storage or shipping container, it should be understood that the techniques and features disclosed herein are applicable to other types of storage containers, including stationary storage containers. The containers disclosed herein may be configured to be carried or transported in a plurality of ways or configurations.

In one exemplary embodiment, a storage container is provided. The storage container includes a base, a lid, and a latch configured to move between a first unsecured position in which the lid is removable from the base and a second secured position in which the lid is removably secured to the base. The latch is at least partially positioned in an aperture defined by the base and the lid. The latch includes an outer edge positioned at a first end of the latch, the outer edge configured to engage one of the lid and the base to maintain the latch in the aperture. The latch also includes a resilient portion positioned at a second end of the latch, the second end being opposite the first end, the resilient portion configured to engage the other of the lid and the base.

In another exemplary embodiment, a storage container includes a base having an interior storage volume and a lid configured to close the interior storage volume of the base when the lid is placed in a closed position on the base. The storage container also includes a latch configured to move between an unsecured position in which the lid is movable from the closed position and a secured position in which the lid is retained in the closed position on the base by the latch. The latch is configured to at least partially extend through an aperture having both a lid portion and a base portion. The latch includes an extended edge positioned at a first end of the latch where the extended edge configured to engage the lid to prevent the latch from passing entirely through the lid portion of the aperture. The latch is captured by the lid and floats within the lid portion of the aperture when the latch is in the unsecured position. The latch also includes a resilient portion positioned at a second end of the latch. The resilient portion is configured to engage an opening in the base portion of the aperture to selectively retain the lid and the body in the closed position when the latch is in the secured position. The latch is not permanently attached to either the base or to the lid.

In yet another exemplary embodiment, a portable storage container is provided. The portable storage container includes a base, a lid, and a latch for releasably securing the base to the lid. The base and the lid define an interior of the container configured to store one or more items. The base includes one or more sides, at least one of the one or more sides including a lower receiver. The lid includes an upper receiver. The latch includes one or more resilient tabs each configured to be at least partially positioned within the upper receiver when the latch is in a first unsecured position and to releasably engage a corresponding engaging portion of the lower receiver when the latch is in a second secured position. The latch also includes a secondary tab formed from a resilient material, the secondary tab configured to provide a biasing force when the latch is in the first unsecured position to engage the lid thereby maintaining the latch in the first unsecured position.

Other variations and embodiments are possible, including variations and embodiments which do not necessarily include all of the elements described above or below and/or variations and embodiments which may include additional elements.

DETAILED DESCRIPTION

Figure 1:
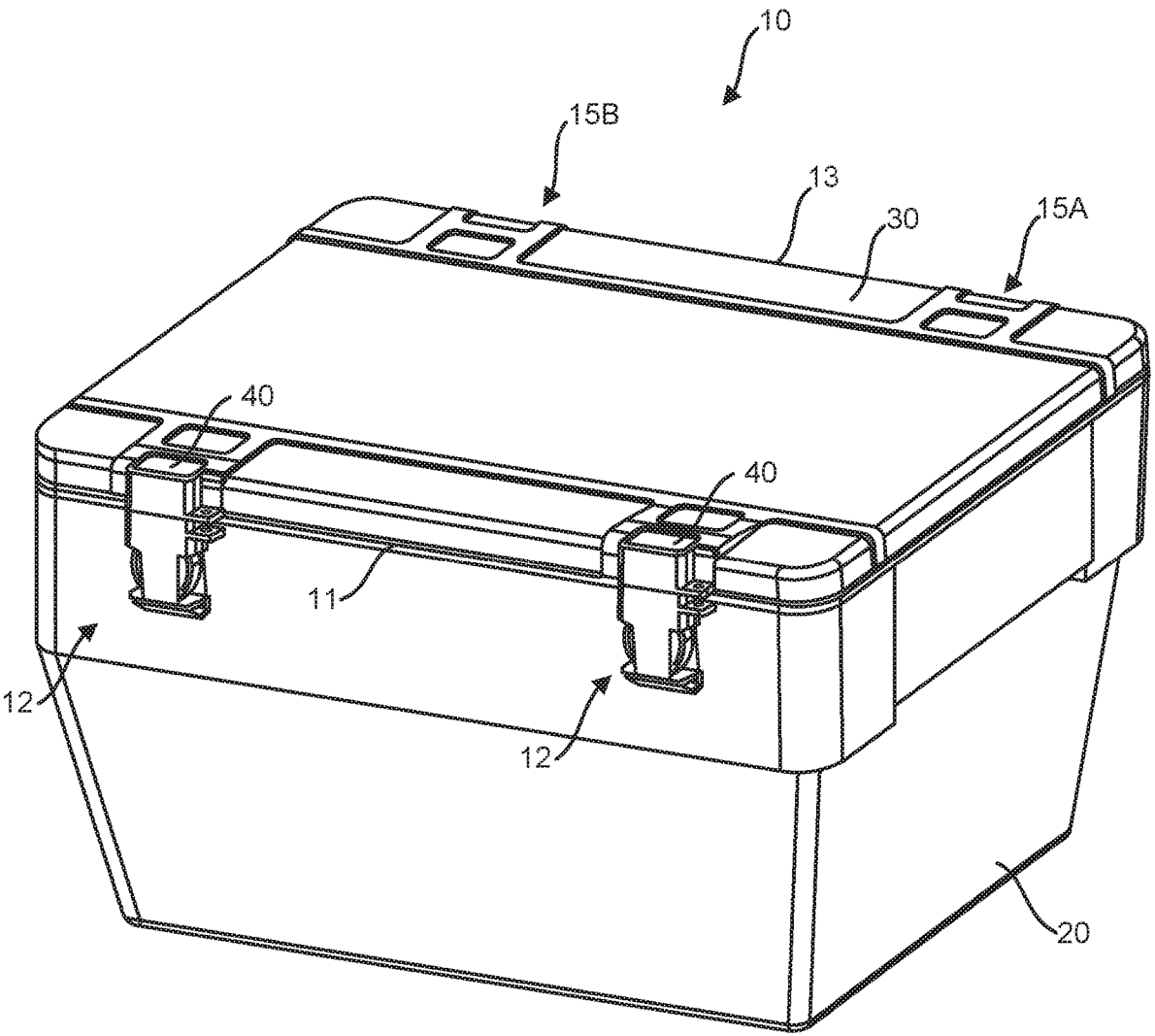
FIG. 1 illustrates a storage container including an exemplary latch for removably securing a lid of the storage container to a base of the storage container.

FIG. 1 illustrates a storage container 10, illustratively a portable storage container such as a shipping cooler, in accordance with the techniques and improvements disclosed herein. Although illustrated as a shipping cooler, in other embodiments, the storage container 10 may be an insulated or non-insulated container, and the storage container 10 may be a portable or stationary container.

Storage container 10 includes a base 20 and a removably attachable lid 30. Lid 30 is removably or temporarily secured to base 20 with one or more securing mechanisms 12 including latch 40, which may also be referred to as a latching mechanism, a clasp, and/or a clasping mechanism. Base 20 and lid 30 define an interior (not illustrated in FIG. 1) of storage container 10 configured to store or ship one or more objects. Each of base 20 and lid 30 may include insulation or one or more thermally insulating elements, such as foam, expanding foam, closed cell foam, structural foam, spray foam, blanket materials, one or more evacuated cavities, one or more vacuum panels, or combinations thereof. In some examples, one or more insulating elements or panels may also be replaceable, exchangeable, and/or swappable.

As illustrated in FIG. 1, in some exemplary embodiments, securing mechanism 12 is positioned proximate a corner of storage container 10. In other exemplary embodiments, securing mechanism 12 is positioned away from the corners of storage container 10, such as substantially centered along a side of storage container 10.

Two instances of securing mechanism 12 are illustrated in FIG. 1. However, it should be understood that other configurations are possible including one, three, four, five, six, or more instances of securing mechanism 12. In one exemplary embodiment, storage container 10 includes two or more securing mechanisms 12 positioned on opposite sides 11, 13 of storage container 10. In another exemplary embodiment, storage container 10 includes two or more securing mechanisms 12 each positioned proximate a corner of storage container 10. In yet other embodiments, one or more securing mechanisms is included along two, three, or four sides of storage container 10. Securing mechanism(s) 12 enable storage container 10 to be temporarily, selectively, or removably retained in a closed position while still allowing lid 30 to be selectively moved to or configured to an opened position permitting access to the interior storage volume or cavity of storage container 10.

In some exemplary embodiments, a storage container includes a first securing mechanism 12 positioned along first side 11 of lid 30, and one or more hinges 15 connecting base 20 to lid 30 positioned along second side 13 of lid 30, wherein first side 11 is opposite second side 13. In other embodiments, the securing mechanism is positioned on the same side or a side adjacent to the side 13 including hinge 15. In some exemplary embodiments, the storage container includes a first hinge 15A and a second hinge 15B both spaced along second side 13 of lid 30. In some exemplary embodiments, the storage container includes two or more securing mechanisms 12 along a first side 11 of lid 30 and two or more hinges 15A, 15B along an opposing second side 13 of lid 30. In some cases, lid 30 and base 20 may have non-overlapping tabs or edges around their perimeters such that it is easier to grasp or pry one or the other in order to open storage 10 when it is tightly sealed closed.

Figure 16A:
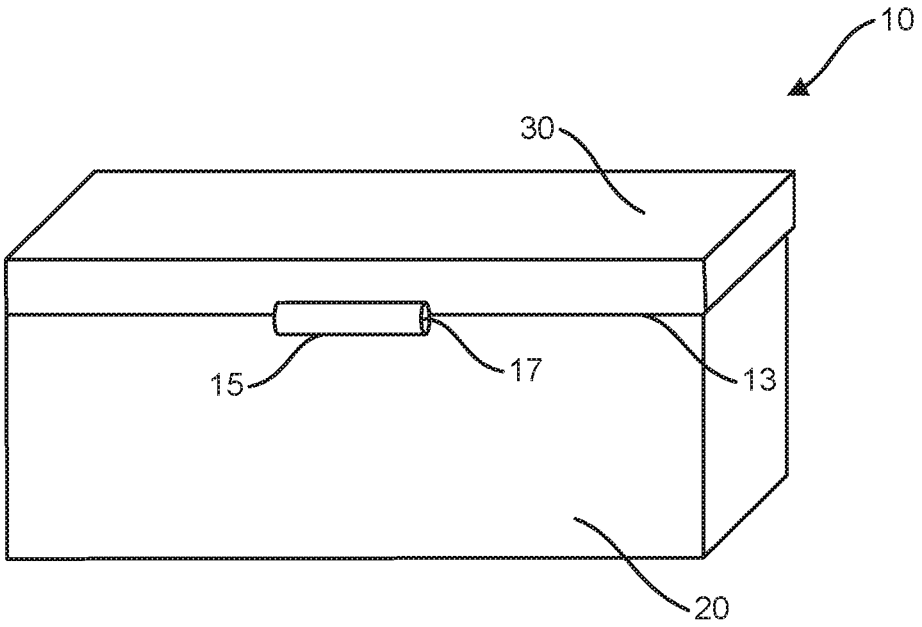
FIG. 16A illustrates an exemplary simple hinge of the storage container of FIG. 1.

Referring to FIG. 16A, hinge 15 pivotably or rotatably couples base 20 to lid 30. In some embodiments, hinge 15 is a simple hinge having a single rod along the pivot axis of hinge 15. In some embodiments, the rod 17 is detachable from base 20 and/or lid 30 to allow lid 30 to be completely disconnected from base 20. In some embodiments, providing a simple hinge 15 as illustrated in FIG. 16A provides for a simpler construction and reduces manufacturing costs.

Figure 16B:
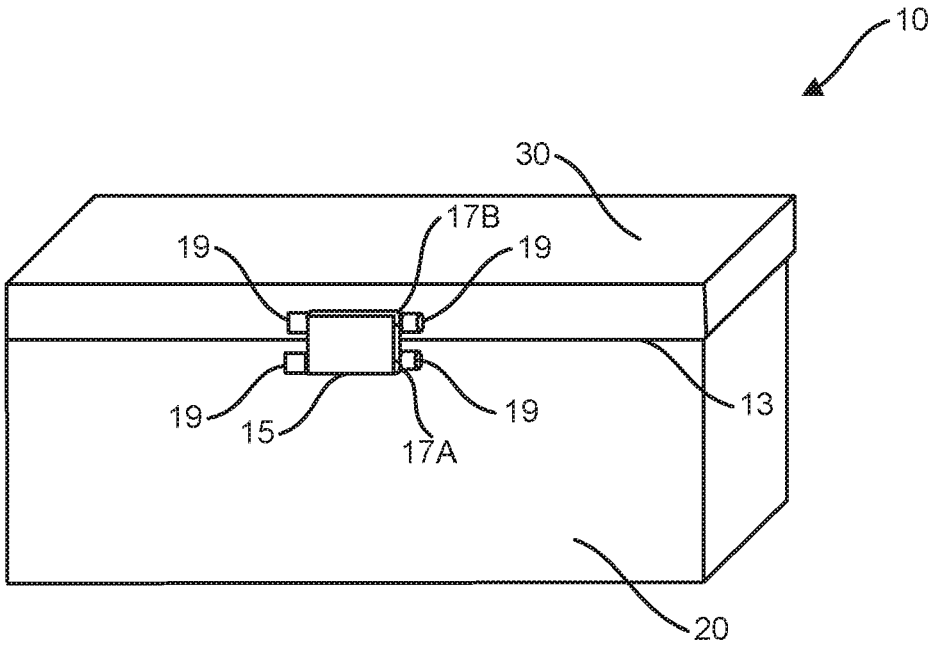
FIG. 16B illustrates an exemplary compound hinge of the storage container of FIG. 1.

Referring to FIG. 16B, in some embodiments, hinge 15 is a compound hinge having a first rod 17A along a first pivot axis attached to base 20 and a second rod 17B along a second pivot axis attached to lid 30. In some embodiments, hinge 15 is at least partially recessed within base 20 and/or lid 30. In some embodiments, one or more of first rod 17A and second rod 17B is detachable from the and associated receiver 19 in order to allow lid 30 to be easily disconnected and reconnected to base 20. This may be accomplished by creating an interference or snap fit between the rod and the associated receiver. In other words, one or more portions of compound hinge 15 may be selectively detachable from another portion of the hinge making it easy to detach and reattach the lid to the base. The hinge may be configured such that the lid can be easily removed by holding the lid in an opened position with one hand and applying a quick, moderate force to the lid with the other hand in order to separate the portions of the hinge. Easy lid removal may be beneficial for one or more of several reasons including cleaning, replacement, storage, exchange, and/or nested stacking of multiple bases.

In some embodiments, providing a compound hinge 15 as illustrated in FIG. 16B allows for a thinner hinge 15, allowing for adjacent storage containers 10 to be positioned closer together. In some embodiments, providing a compound hinge 15 as illustrated in FIG. 16B provides for a more advantageous distribution of forces between the base 20 and lid 30, for example making it more likely that a closed lid 30 will remain attached to base 20 in the case of an impact such as a drop of storage container 10. In some embodiments, providing a compound hinge 15 as illustrated in FIG. 16B allows for lid 30 to be rotated further back relative to base 20, allowing for easier packing of the interior of storage container 10.

Any of the embodiments disclosed herein may contain one, two, three, four, or more of the disclosed hinges. In other embodiments, storage container 10 may include no hinges.

Figure 2:
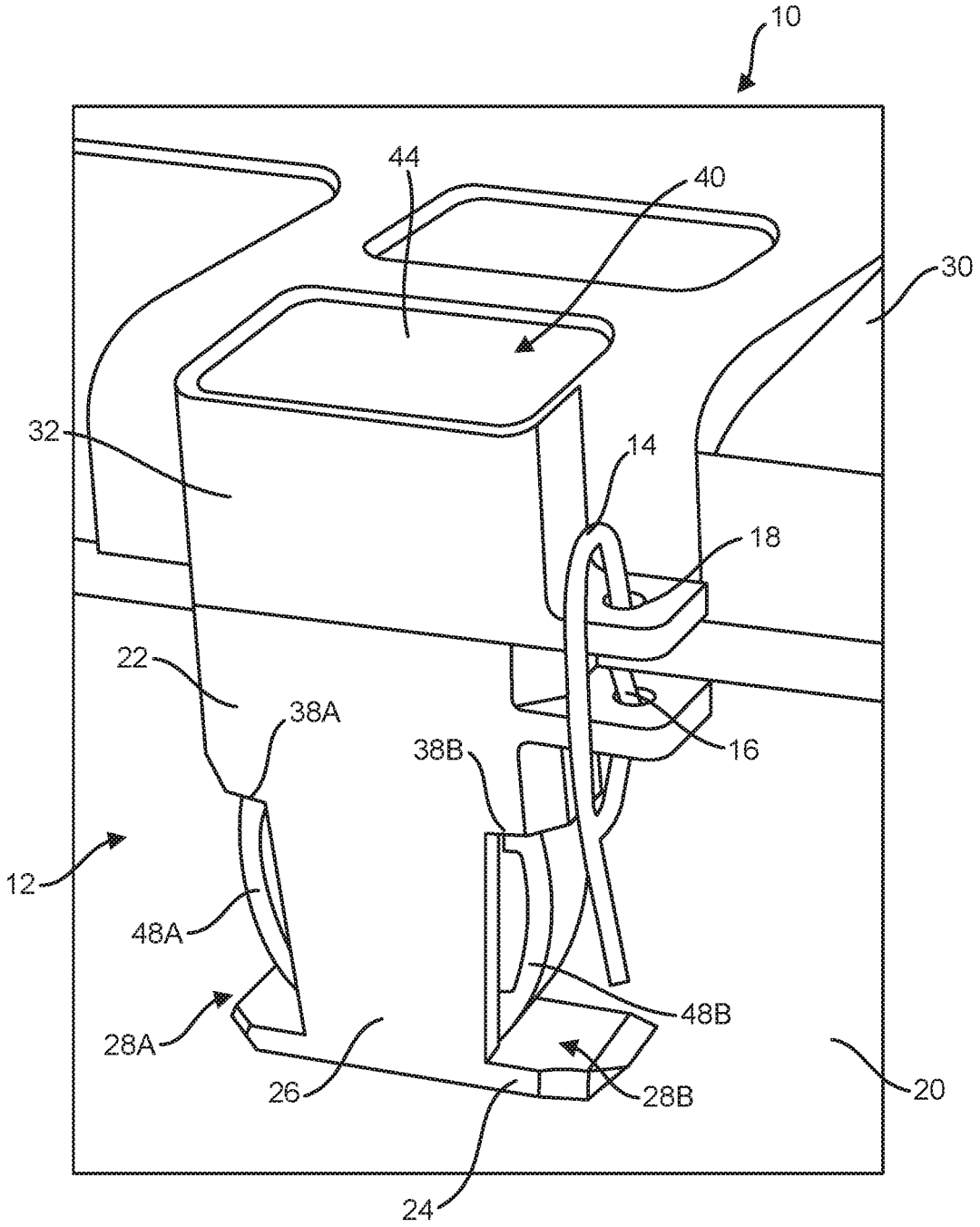
FIG. 2 illustrates an enlarged view of the securing mechanism of FIG. 1.

As shown in FIG. 2, base 20 of storage container 10 includes a lower receiver 22 extending from an upper side of base 20. Lower receiver 22 may be formed as part of base 20 or may be a separate component attached to base 20. Lower receiver 22 is configured to receive at least a portion of latch 40 to secure latch 40 to the base 20. In some illustrative embodiments, lower receiver 22 includes a lower shelf 24 connecting a lower end of lower receiver to base 20. Lower receiver 22 further includes an engagement portion 26 including one or more openings 28 (illustrated as first opening 28A and second opening 28B in FIG. 2) providing external access to a portion of latch 40. Lower receiver 22 further includes one or more engaging portions 38 (illustrated as first engaging portion 38A and second engaging portion 38B in FIG. 2) configured to engage a portion of latch 40 to secure base 20 to lid 30.

As also shown in FIG. 2, lid 30 of storage container 10 includes an upper receiver 32 extending from a side of lid 30. Upper receiver 32 is configured to receive at least a portion of latch 40 to secure latch 40 to the lid 30 which secures lid 30 to base 20. Upper receiver 32 may be formed as part of lid 30 or may be a separate component attached to lid 30.

As shown in FIG. 2, in some exemplary embodiments, lower receiver 22, upper receiver 32, and/or latch 40 may have a substantially rectangular cross-section. In other exemplary embodiments, lower receiver 22, upper receiver 32, and/or latch 40 may have another suitable cross-section, such as substantially square, substantially triangular, substantially trapezoidal, substantially polygonal, substantially circular, or substantially oval.

Referring to FIG. 2, in some exemplary embodiments, storage container 10 includes a tamper-resistant or tamper-evident structure 14. Exemplary tamper-evident structures 14 include zip-ties, cable-ties, pull-tight seals, heat shrink bands, tamper evident labels, tamper evident closures, and tamper-evident stickers. In the exemplary embodiment illustrated in FIG. 2, tamper-evident structure 14 is a cable-tie or zip-tie threaded through a first aperture 16 in base 20 and a second aperture 18 in lid 30 before being secured to itself to form a loop. In another exemplary embodiment, a tamper-evident structure 14, such as a tamper-evident label, is placed over a portion of latch 40, such as upper portion 44. A missing, deformed, or broken tamper-evident structure 14 indicates to a user that the storage container 10 may have been opened since the tamper-evident structure was applied by the party packing or shipping storage container 10.

Figure 8A:
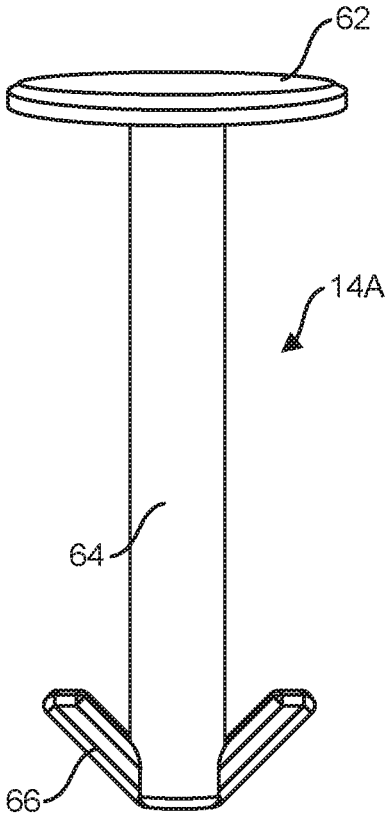
FIG. 8A illustrates an exemplary tamper-evident structure.
Figure 8B:
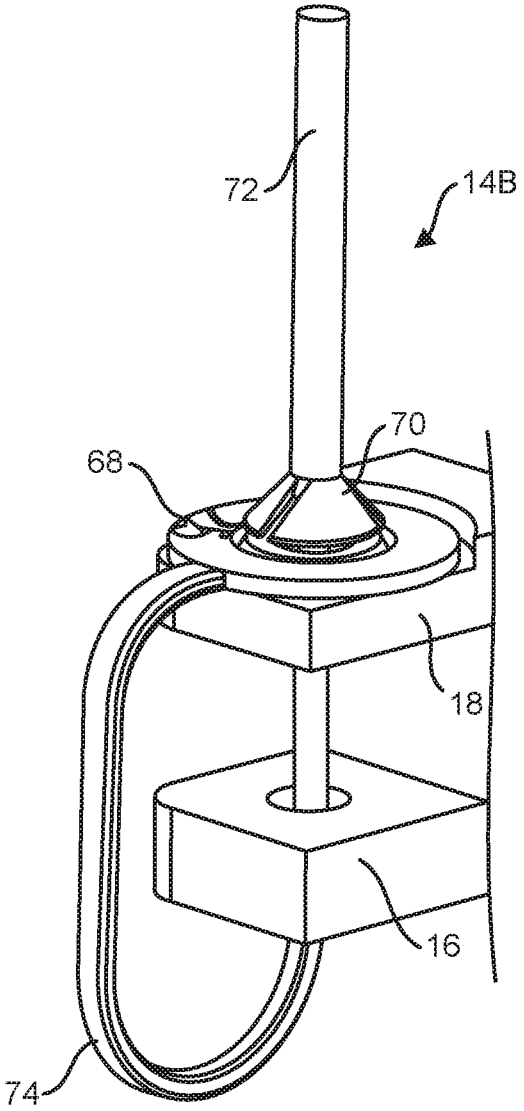
FIG. 8B illustrates another exemplary tamper-evident structure.

Referring next to FIGS. 8A and 8B, additional exemplary tamper-evident structures 14A, 14B are illustrated. Tamper-evident structures 14A, 14B clearly indicate to a user when the structure 14A, 14B has been removed, indicating to a user that the storage container 10 may have been opened during transit. As shown in FIG. 8A, tamper-evident structure 14A includes a head 62 and a body 64 extending to one or more resilient projections 66. The resilient projections 66 are configured to be deformed towards body 64 as tamper-evident structure 14A is received through first aperture 16 and second aperture 18 of the storage container 10 (see FIG. 2). The head 62 and resilient projections 66 resist tamper-evident structure 14A from being removed from first and second apertures 16, 18. To remove tamper-evident structure 14A, resilient projections 66 are broken off body 64, allowing body 64 to be removed from apertures 16, 18.

As shown in FIG. 8B, another exemplary tamper-evident structure 14B includes a head 68 including a one-way aperture 70 and tail 72. To secure tamper-evident structure 14B to storage container 10, tail 72 is threaded through first aperture 16 and second aperture 18. Tail 72 is then placed into one-way aperture 70 of head 68 and pulled tight. In the exemplary embodiment illustrated in FIG. 8B, tail 72 has a substantially cylindrical shape. In other exemplary embodiments, tail 72 may include one or more spheres (not shown) over which one-way aperture 70 must be passed. The one-way aperture 70 resists tail 72 from being pulled back out of head 68. To remove tamper-evident structure 14B, either the one-way aperture 70 is broken to release tail 70, or a central portion 74 of tail 72 is cut indicting the container may have been opened.

Figure 3:
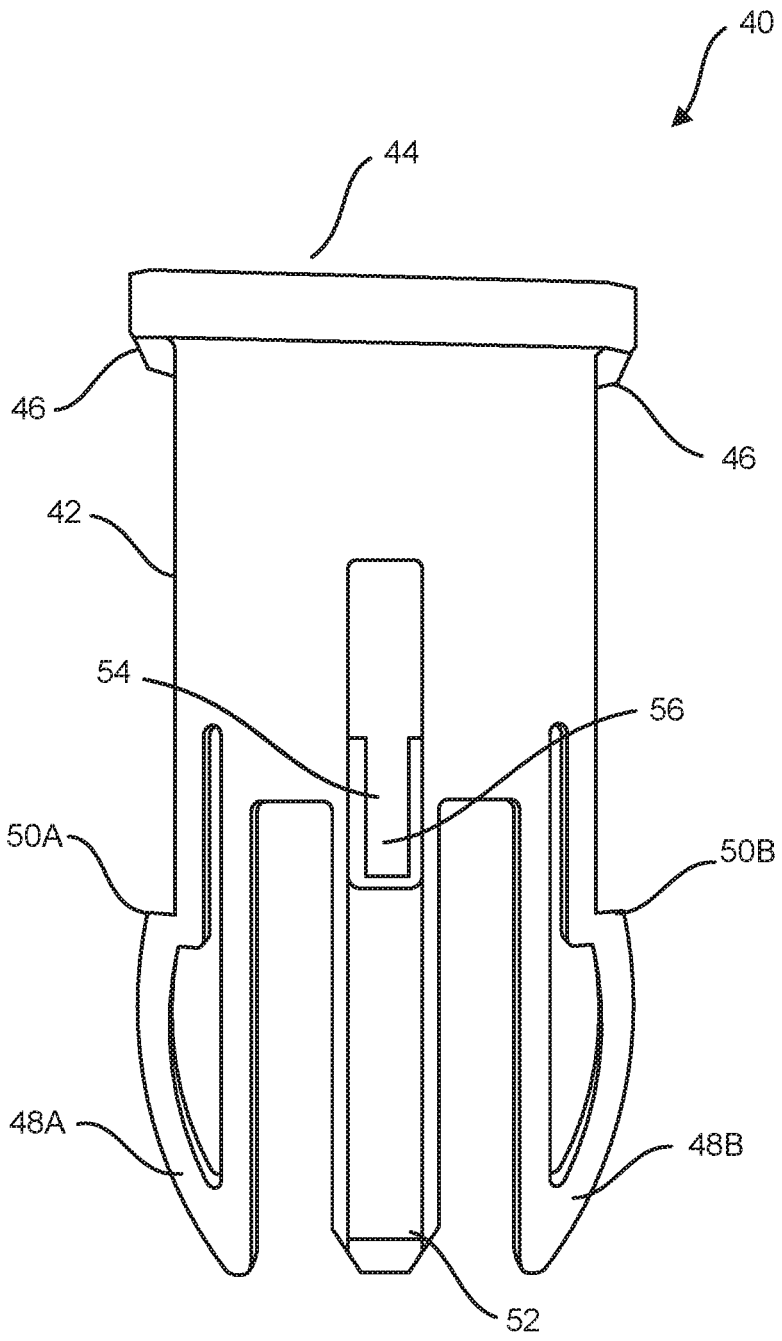
FIG. 3 illustrates a front view of the latch of the securing mechanism of FIG. 2.

Referring next to FIG. 3, an exemplary latch 40 is illustrated. Latch 40 includes a body 42 sized to be at least partially received within upper receiver 32 of lid 30. Latch 40 further includes an upper portion 44 having an outer edge 46 extending beyond body 42. As explained below, outer edge 46 has an area greater than a corresponding aperture of upper receiver 32 and is configured to contact a portion of upper receiver 32 of lid 30 such that latch 40 cannot pass all the way through upper receiver 32. In other words, latch 40 will can be inserted into upper receiver 32 only to a certain point. Once latch 40 is in this position and engages base 20, as discussed in more detail below, latch 40 secures lid 30 to base 20.

As shown in FIG. 3, latch 40 further includes one or more resilient portions 48 configured to engage lower receiver 22 of the base 20. Each resilient portion 48 is at least partially formed of a resilient and/or flexible material, such as a plastic or a metal. In some exemplary embodiments, the resilient portions 48 include one or more flexible tabs (illustrated as first tab 48A and second tab 48B in FIG. 3). Each flexible tab 48A, 48B includes projections (illustrated as first projection 50A and second projection 50B in FIG. 3) configured to releasably engage corresponding engaging portions 38 on lower receiver 22 of base 20. In other exemplary embodiments, the resilient portion 48 includes a button or push-tab (not illustrated in FIG. 3) configured to releasably engage a corresponding engaging portion 38 on lower receiver 22 of base 20. As explained below, the resilient portions 48 are biased in a first direction. A user can apply a force, such as by pressing on the resilient portion 48, to overcome the biasing force and move the resilient portion to a second position, thereby allowing the latch 40 to move between a secured position in which latch 40 secures lid 30 to base 20 and an unsecured position in which lid 30 is able to be removed from base 20.

Figure 7:
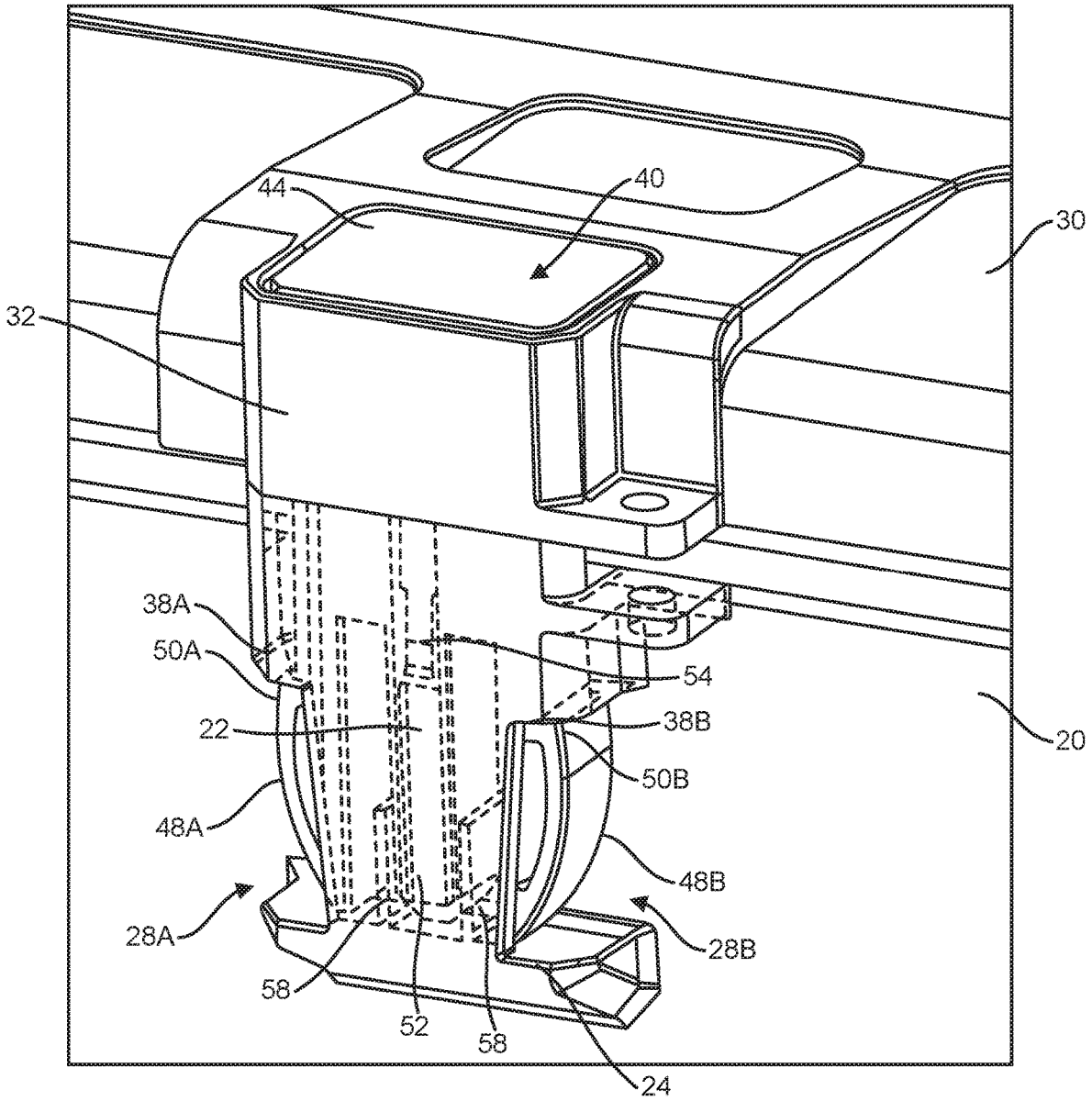
FIG. 7 illustrates a partial cut-away view of the securing mechanism of FIG. 6 in the secured position.

In some exemplary embodiments, latch 40 further includes central member 52. As illustrated in FIG. 7, central member 52 is configured to be received by one or more guides 58 of the lower receiver 22 of the base 20.

Referring again to FIG. 3, in some exemplary embodiments, latch 40 includes secondary tab 54 having an end projection 56 positioned at a distal end of secondary tab 54.

Figure 4:
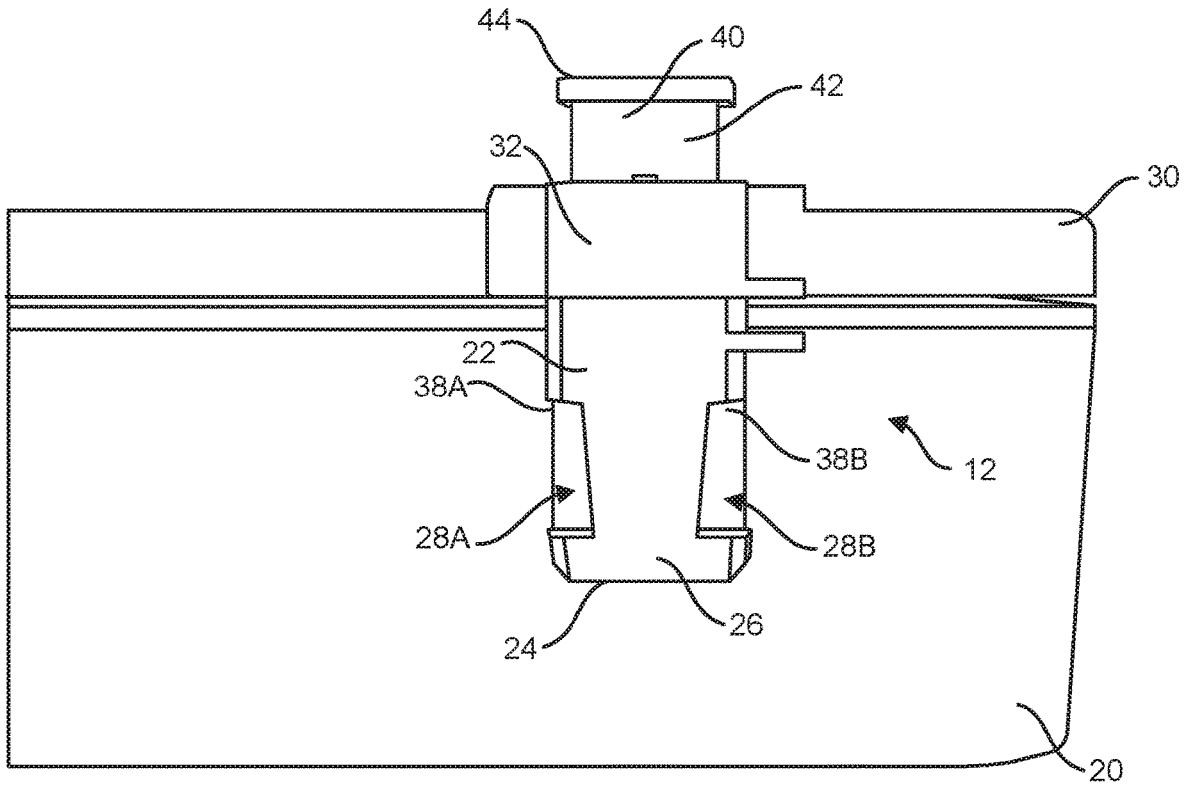
FIG. 4 illustrates the securing mechanism of FIG. 2 in an unsecured position.
Figure 5:
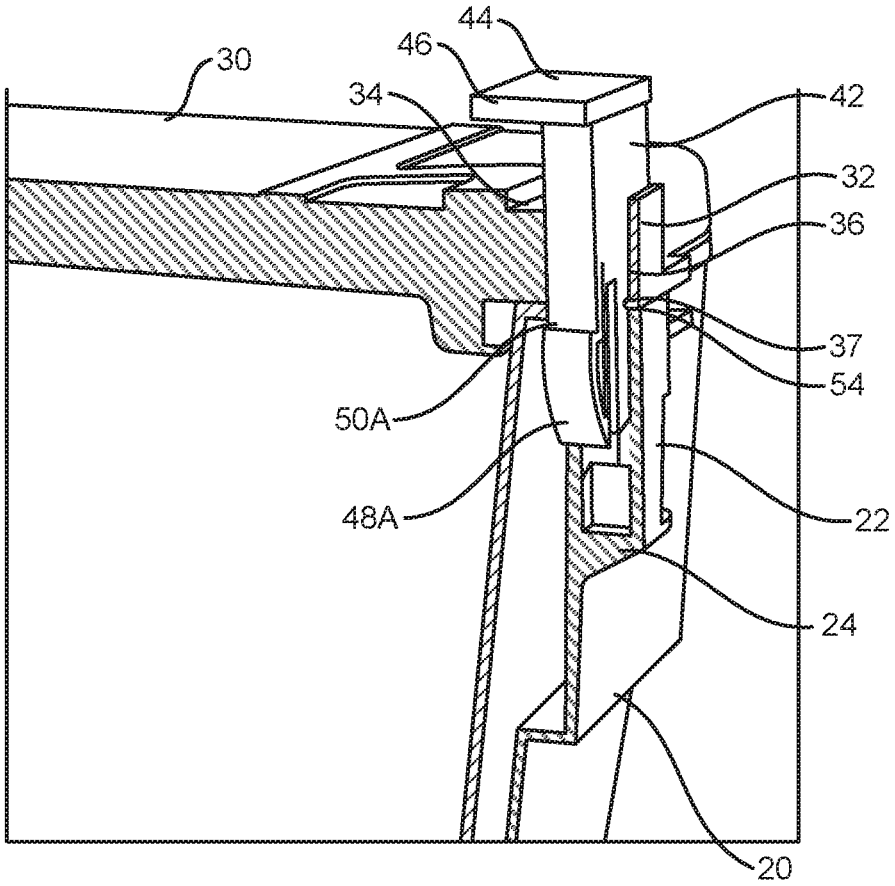
FIG. 5 illustrates a sectional view of the securing mechanism of FIG. 4 in the unsecured position.

Secondary tab 54 is configured engage a corresponding stop recess 36 on lid 32 to resist latch 40 from being removed from upper receiver 32 of lid 30 unless a specific effort is made to do so. Secondary tab 54 is further configured to engage minor ledge 37 on lid 32 to maintain latch 40 in the unsecured position, as shown in FIGS. 4 and 5. At least a portion of secondary tab 54 is illustratively formed from a resilient material to allow secondary tab 54 to be biased such that end projection 56 tends to be extended to engage with stop recess 36 and/or minor ledge 37. An external force may need to be applied to secondary tab 54, such as by a user, such that it deflects and bypasses stop recess 36 enabling latch 40 to be fully or completely removed from lid 30.

Although FIG. 3 illustrates secondary tab 54 as being positioned on central member 52, in other exemplary embodiments, secondary tab 54 is positioned on body 42, upper portion 44, or a resilient portion 48 of latch 40. In other exemplary embodiments (not shown), secondary tab 54 is provided as part of upper receiver 32 and a corresponding stop recess 36 is provided on latch 40.

Referring next to FIGS. 4 and 5, an exemplary storage container 10 is illustrated with the latch 40 in an unsecured position. In this position, lid 30 can be removed from base 20. Upper portion 44 of latch 40 extends above an upper surface 34 of lid 30 such that at least a portion of body 42 of latch extends out of upper receiver 32 of lid 30. The flexible tabs 48A, 48B of latch 40 extend below upper receiver 32 of lid 30. When lid 30 is aligned with and placed onto base 20, the flexible tabs 48A, 48B may at least partially extend into lower receiver 22 of base 20. However, the projections 50A, 50B of resilient tabs 48A, 48B do not engage with the corresponding engaging portions 38A, 38B when the latch 40 is in the unsecured position, as shown in FIGS. 4 and 5.

Latch 40 is retained in the unsecured position by the secondary tab 54. Further upward motion of latch 40, such as attempting to remove latch 40 completely from upper receiver 32, is resisted by the end projection 56 being retained in stop recess 36 of upper receiver 32. Downward motion of latch 40 toward the secured position, such as shown in FIGS. 6 and 7, is resisted by the biasing force of the end projection 56 and secondary tab 54 against the internal surface of stop recess 36.

Figure 6:
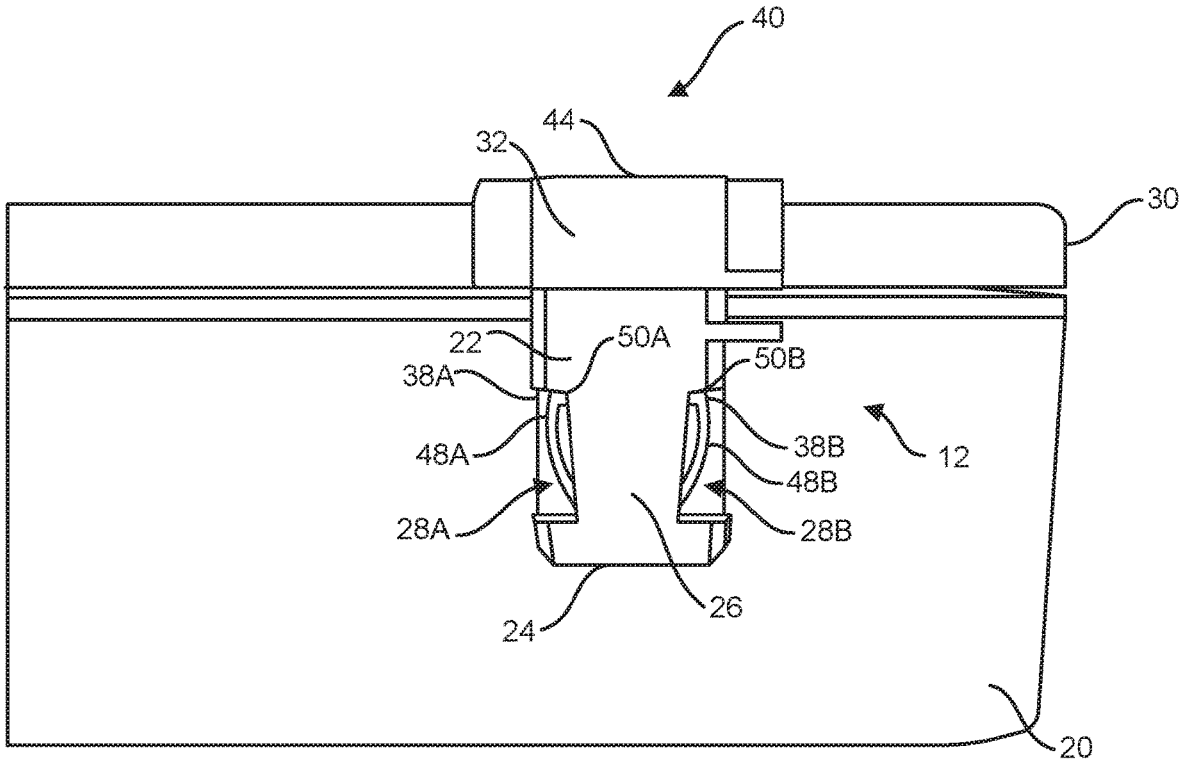
FIG. 6 illustrates that securing mechanism of FIG. 2 in a secured position.

Upon application of sufficient force, the biasing force of secondary tab 54 is overcome, and the latch 40 is moved from the unsecured position illustrated in FIGS. 4 and 5 to the secured position shown in FIGS. 6 and 7. In some exemplary embodiments, the force to move latch 40 is applied by pushing on upper portion 44 of latch 40, which is initially positioned above the upper surface 34 of lid 30. Latch 40 is able to continue to move downward until the outer edge 46 of upper portion 44 contacts upper surface 34 of lid.

As illustrated in the cross sectional view of FIG. 4, in the unsecured position, the engagement of secondary tab 54 with stop recess 36 results in latch 40 being captured within upper receiver 32 of lid 30. Latch 40 is able to move between the unsecured position illustrated in FIGS. 4 and 5 and the secured position illustrated in FIGS. 6 and 7 with the application of only a small amount of force, but such a force will not typically move latch 40 upward from the unsecured position illustrated in FIGS. 4 and 5 to a removed position. In this way, latch 40 may be said to float within upper receiver 32, allowing it to move between the secured and unsecured positions while still being captured or retained by lid 30 such that latch 40 is not easily or unintentionally separated from lid 30. At the same time, latch 40 may still be removable from lid 30 only after a separate, deliberate step is performed. In this way, latch 40 will only be separated from lid 30 when this separate step is performed and not simply as a result of opening or closing the storage container.

In some exemplary embodiments, a larger force applied upward to latch 40 in the unsecured position results in the secondary tab 54 being further depressed or broken off such that the latch 40 can be removed from upper receiver 32 of lid 30. A replacement tab 40 can then be inserted into upper receiver by depressing secondary tab 54 and moving latch 40 downward relative to lid 30 until secondary tab 54 engages stop recess 36. In some embodiments, this is desirable to allow latch 40 to be replaced or removed, such as for cleaning, upon deliberate application of a stronger upward force to tab 40, but prevents latch 40 from being easily removed from or falling out of lid 30, such as during shipping of storage container 10, or upon application of only lesser forces.

FIGS. 6 and 7 illustrate the latch 40 positioned in the secured position. In this position, lid 30 is secured to the base 20. Upper portion 44 of latch 40 no longer extends above an upper surface 34 of lid 30, and the body 42 of latch extends through upper receiver 32 of lid 30 and lower receiver 22 of base 20. The alignment member 52 is received between guides 58.

As illustrated in FIGS. 6 and 7, when the latch 40 is positioned in the secured position, the biasing force on the flexible tabs 48A, 48B causes them to extend outward such that the projections 50A, 50B engage with the corresponding engaging portions 38A, 38B of the lower receiver 22, securing the base 20 to the lid 30 and resisting movement of latch 40 back out of the secured position towards the unsecured position. In some exemplary embodiments, a first latch 40 may be replaced with a second latch 40 having at least one property different from the first latch 40. For example, the second latch 40 may have flexible tabs 48A, 48B with a stronger or weaker biasing force than flexible tabs 48A, 48B of first latch 40, or the second latch 40 may be at least partially formed from different materials than first latch 40, depending on the intended application for storage container 10.

To return the latch 40 back to the unsecured position as illustrated in FIGS. 4 and 5, an external force is applied to flexible tabs 48A, 48B to overcome the biasing force, such that the projections 50A, 50B no longer engage with the corresponding engaging portions 38A, 38B. Once the projections 50A, 50B are clear of the corresponding engaging portion 38A, 38B, the latch 40 can be moved upward back to the unsecured position, and the lid 20 may then be removed from the base 30. In some exemplary embodiments, at least one of the flexible tabs 48A, 48B and secondary tab 54 may provide a biasing force against lower receiver 32 tending to move the latch 40 towards the unsecured position once projections 50A, 50B are clear of the corresponding engaging portion 38A, 38B.

In the exemplary embodiments illustrated in FIGS. 6 and 7, the upper portion 44 of latch 40 is substantially flush with the upper surface of lid 30 when in the secured position. This configuration provides a relatively small vertical profile for securing mechanism 12, which allows for multiple storage containers 10 to be stacked on top of each other for shipping and/or storage. Additionally, in the exemplary embodiments illustrated in FIGS. 6 and 7, the lateral profile of the securing mechanism 12 is relatively small, allowing for multiple storage containers 10 to be stacked against each other for shipping and/or storage. In some exemplary embodiments, the securing mechanism 12 can be moved between the secured and unsecured positions with a single hand, such as by depressing the lower edges of flexible tabs 48A, 48B to move the latch 40 upward to the unsecured position, or by pressing down on the upper portion 44 to move the latch downward to the secured position. In some exemplary embodiments, placing another object, such as a second storage container 10, on top of lid 30 and upper portion 44 of latch 40 of a first storage container 10 further secures the latch 40 first storage container 10 in the secured position by providing a downward weight force on upper portion 44 that resists any upward movement of the latch 40 of first storage container 10.

In the exemplary embodiments illustrated in FIGS. 6 and 7, the flexible tabs 48A, 48B are recessed within respective openings 28A, 28B to reduce the possibility of accidental depression of flexible tabs 48A, 48B during shipping and/or handling that would tend to allow latch 40 to release and move to the unsecured position. As further illustrated in FIGS. 6 and 7, lower shelf 24 may serve as a lower guard to prevent accidental release of latch 40 from an unintentional application of force to resilient members 48A, 48B. Base 20 may further include additional guards, such as around one or more sides of lower receiver 22, to further reduce the possibility of accidental release during shipping and/or handling of storage container 10.

Figure 9:
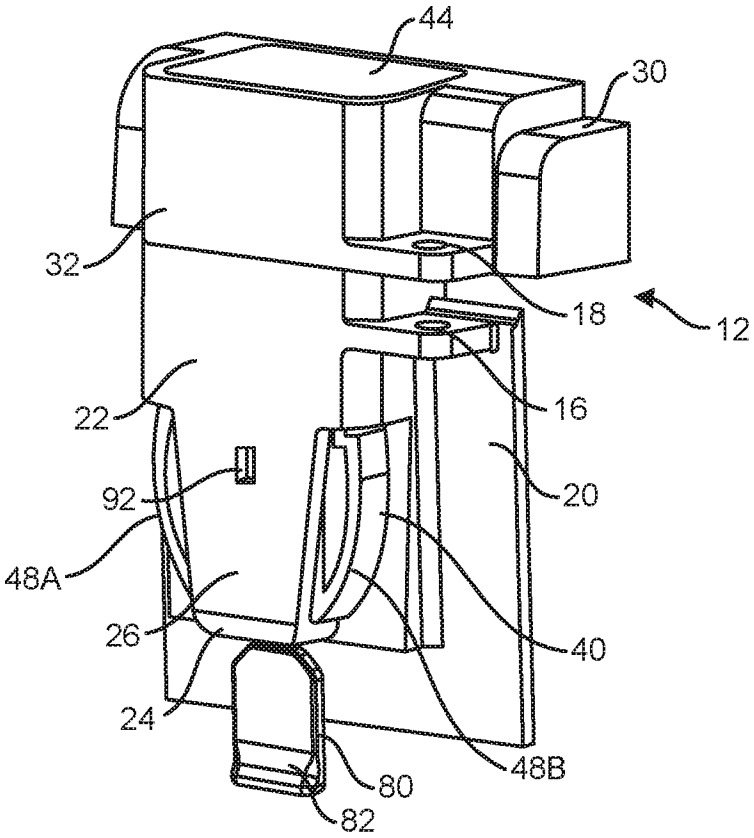
FIG. 9 illustrates an exemplary tamper-evident structure secured in a latch of a portable storage container.

Referring next to FIG. 9, another exemplary securing mechanism 12 for a storage container 10 (see FIG. 1) is illustrated. The securing mechanism 12 illustrated in FIG. 11 includes a tamper-evident tag 80 configured to interface with the latch 40. In some exemplary embodiments, tamper-evident tag 80 is used in conjunction with a tamper-resistant or tamper-evident structure 14, 14A, 14B received through apertures 16, 18 (see FIGS. 2, 8A, 8B).

Figure 10:
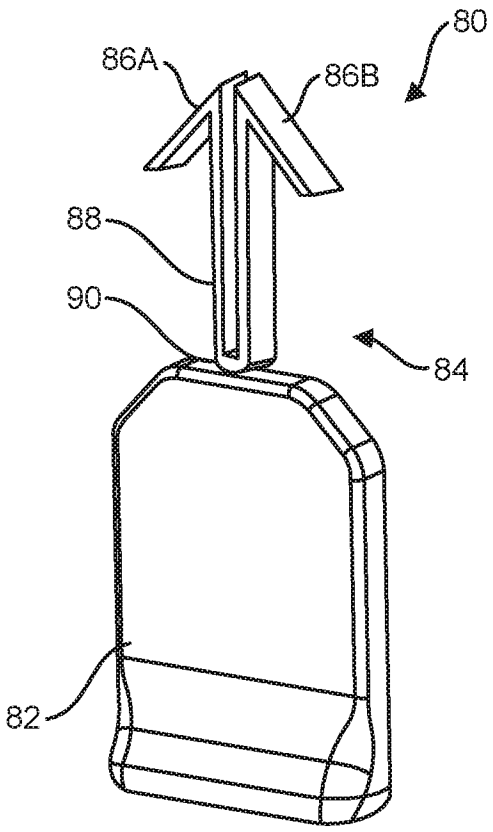
FIG. 10 illustrates the tamper-evident structure of FIG. 9.

Tamper-evident tag 80 is also illustrated in FIG. 10. Tag 80 includes a first grasping portion 82 configured to extend outside securing mechanism 12 when tag 80 interfaces with latch 40 and a insertion portion 84 configured to be at least partially received within securing mechanism 12 when tag 80 interfaces with latch 40. Insertion portion 84 illustratively includes one or more resilient projections 86, shown as first hooked projection 86A and second hooked projection 86B in FIG. 10 extending from shaft 88. In some exemplary embodiments, shaft 88 is formed form two or more parallel portions to allow for additional flexibility of insertion portion 84. In other exemplary embodiments, shaft 88 is formed from a single shaft.

Tamper-evident tag 80 further includes a breakaway point 90. Breakaway point 90 is configured to be the point at which tag 80 ruptures upon application of a sufficient force, such as a substantially downward force on grasping portion 82. In some exemplary embodiments, breakaway point 90 is formed from a reduced cross-section relative to other portions of tag 80, a geometric feature such as a relatively sharp angle, a more fragile material relative to other portions of tag 80, or other suitable means. In some exemplary embodiments, breakaway point 90 is positioned between grasping portion 82 and shaft 88 of insertion portion 84 such that tag 80 breaks between a first portion including grasping portion 82 and a second portion including insertion portion 84 upon sufficient force on grasping portion 82. In some exemplary embodiments, breakaway point 90 is positioned between shaft 88 and projections 86 of insertion portion 84 such that tag 80 breaks between a first portion including grasping portion 82 and shaft 88 and a second portion including projections 86. Other suitable positions for breakaway point 90 may also be used.

FIGS. 11A-11J illustrate additional exemplary embodiments of tamper-evident tags 80A-80H.

Figure 11A:
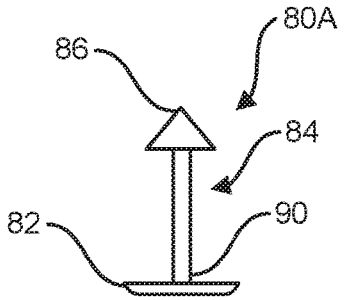
FIGS. 11A-11J illustrate additional exemplary tamper-evident structures.

FIG. 11A illustrates a second exemplary tamper-evident tag 80A with a circular grasping portion 82 and a conical projection 86.

Figure 11B:
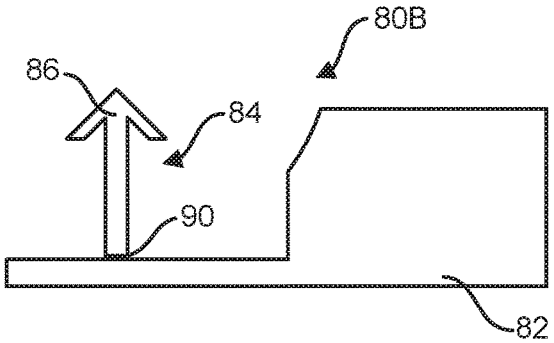

FIG. 11B illustrates a third exemplary tamper-evident tag 82B with a larger, horizontally extending grasping portion 82.

Figure 11C:
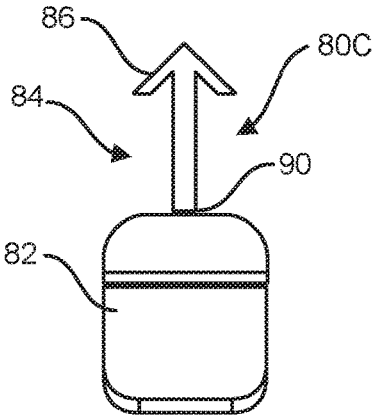

FIG. 11C illustrates a fourth exemplary tamper-evident tag 80C with an angled grasping portion 82.

Figure 11D:
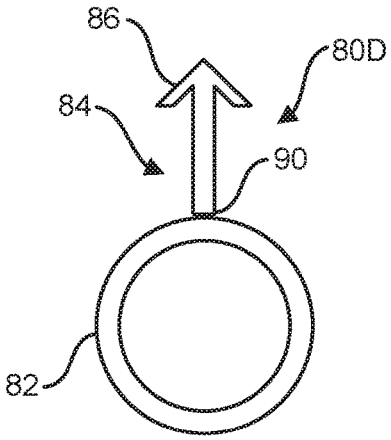

FIG. 11D illustrates a fifth exemplary tamper-evident tag 80D with an annular grasping portion 82.

Figure 11E:
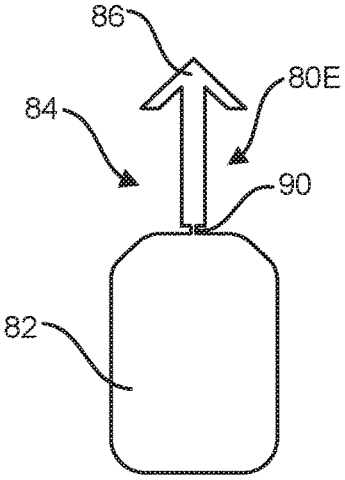

FIG. 11E illustrates a sixth exemplary tamper-evident tag 80E with a flat grasping portion 82.

Figure 11F:
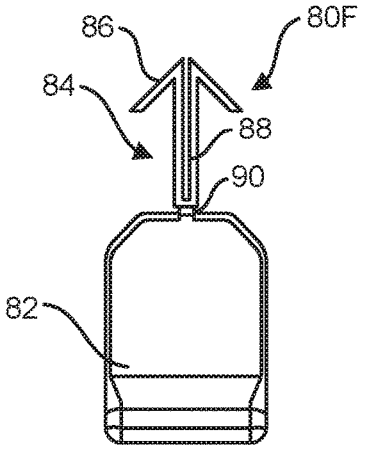

FIG. 11F illustrates a sixth exemplary tamper-evident tag 80F with a raised surface on grasping portion 82 and multiple parallel shafts 88 in insertion portion 84.

Figure 11G:
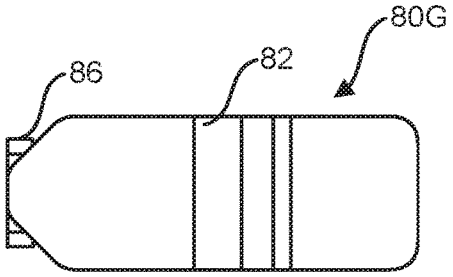
Figure 11H:
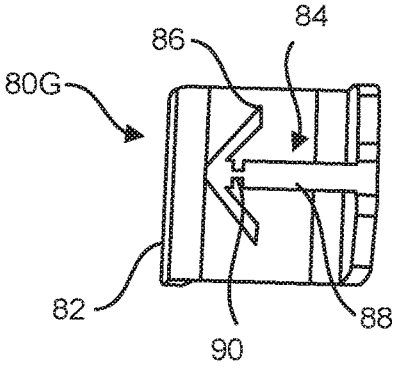
Figure 11I:
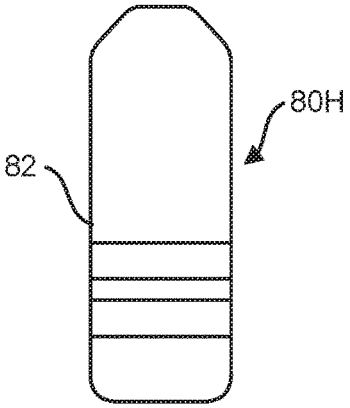

FIG. 11G illustrates a front view and FIG. 11H illustrates a left side view of a seventh exemplary tamper-evident tag 80G. Tag 80G includes a larger horizontally extending grasping portion 82 and a breaking point 90 positioned between the shaft 88 and projection 86.

Figure 11J:
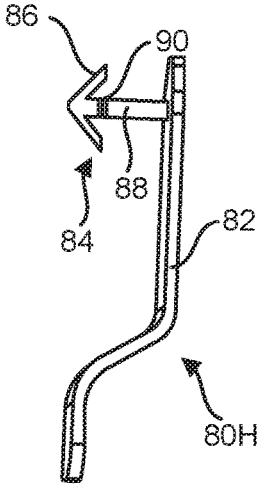

FIG. 1I illustrates a front view and FIG. 11J illustrates a left side view of an eighth exemplary tamper-evident tag 80H. Tag 80H includes a larger vertically extending grasping portion 82 and a breaking point 90 positioned between the shaft 88 and projection 86.

Figure 13:
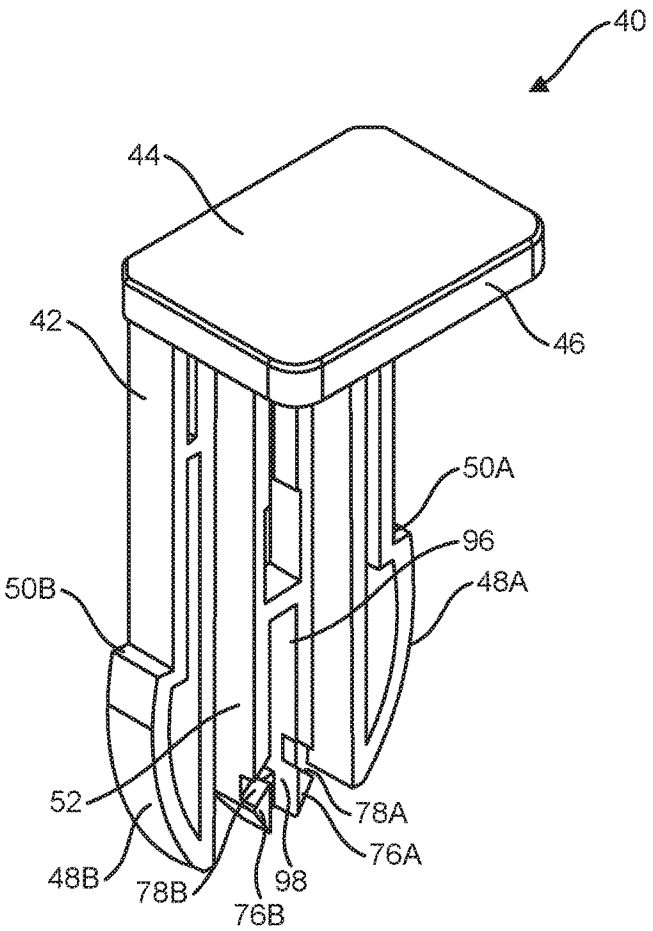
FIG. 13 illustrates a rear perspective view of the latch of FIG. 12.
Figure 14:
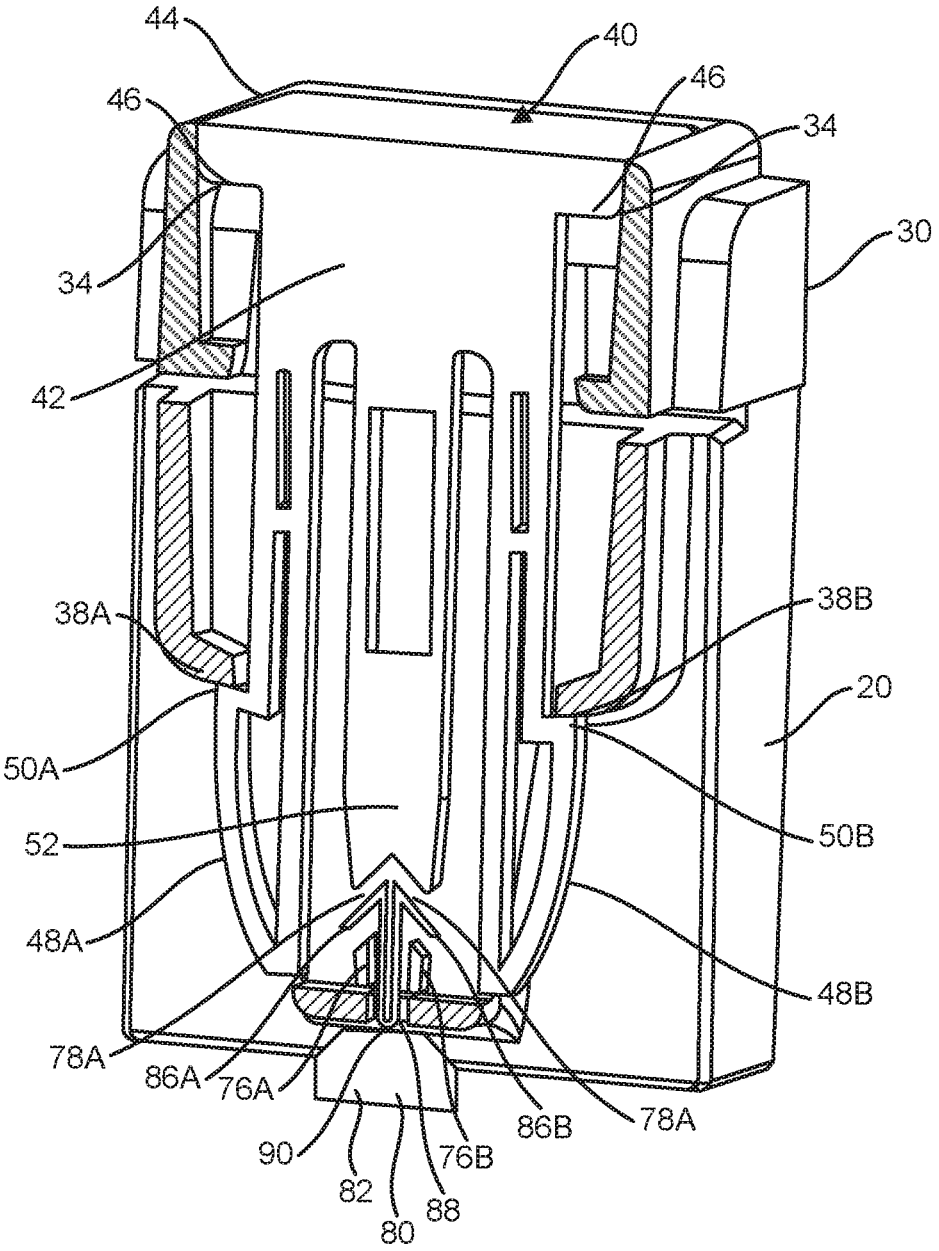
FIG. 14 illustrates a cut-away view of the tamper-evident structure and latch of FIG. 9.

As shown in FIGS. 10 and 11A-11F, in some exemplary embodiments, the tamper-evident tag 80, 80A-80F has an insertion portion 84 including projections 86 that are configured to be inserted through a lower aperture 90 of lower shelf 24 to be received within one or more corresponding slots 78A and 78B in latch 40 (see FIGS. 13, 14). As shown in FIGS. 11G-11J, in some exemplary embodiments, the tamper-evident tag 80G, 80H has an insertion portion 84 including projections 86 that are configured to be inserted through an aperture 92 of lower receiver 22 and/or upper receiver 32 to be received within one or more corresponding slots 94 in latch 40 (see FIGS. 9, 12).

Figure 12:
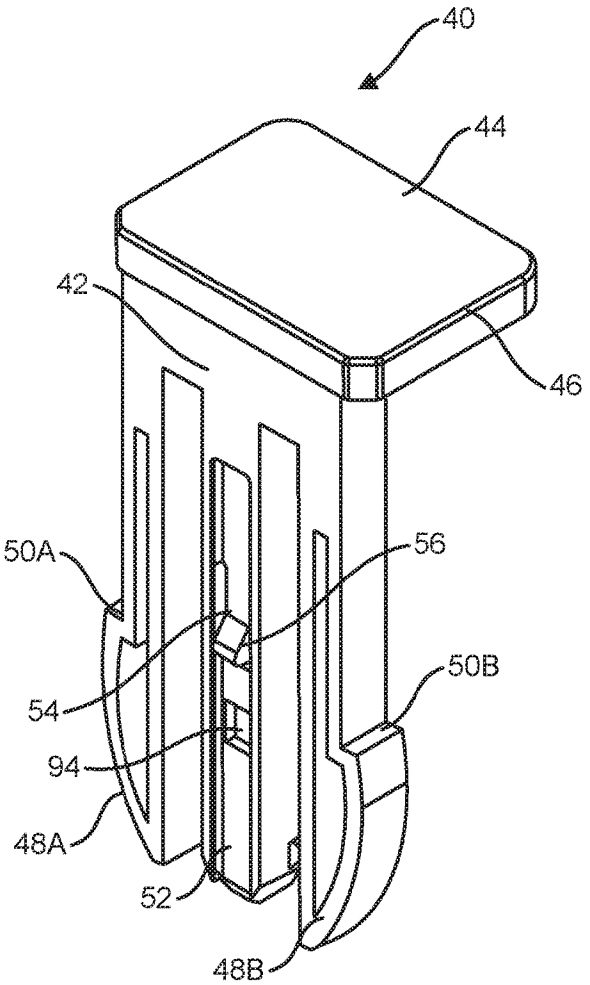
FIG. 12 illustrates a front perspective view of the latch for receiving the tamper-evident structure of FIG. 9.

Referring next to FIGS. 12-14, an exemplary latch 40 for receiving the tamper evident tag 80 is illustrated.

In one exemplary embodiment, latch 40 includes one or more bosses 76 (illustrated in FIG. 13 as first boss 76A and second boss 76B in central member 52) forming a channel 98 for receiving a tamper-evident tag 80 through an aperture 90 in lower shelf 24 of lower receiver 22. In other exemplary embodiments, the aperture 90 may be formed in another portion of lower receiver 22 or upper receiver 32. The channel 98 is open to one or more slots (illustrated in FIG. 13 as first slot 78A and second slot 78B).

In the exemplary embodiment illustrated in FIG. 14, an upper portion of each boss 76A, 76B is tapered away from the channel 98. When utilized with a tag 80 including multiple parallel shafts 88A, 88B, the tapered upper portion is configured to interface with the hooked projections 86A, 86B (see FIG. 15C), tending to separate the parallel shafts 88A, 88B and make it less likely that tag 80 can be removed without breaking tag 80 at breaking point 90.

Figure 15A:
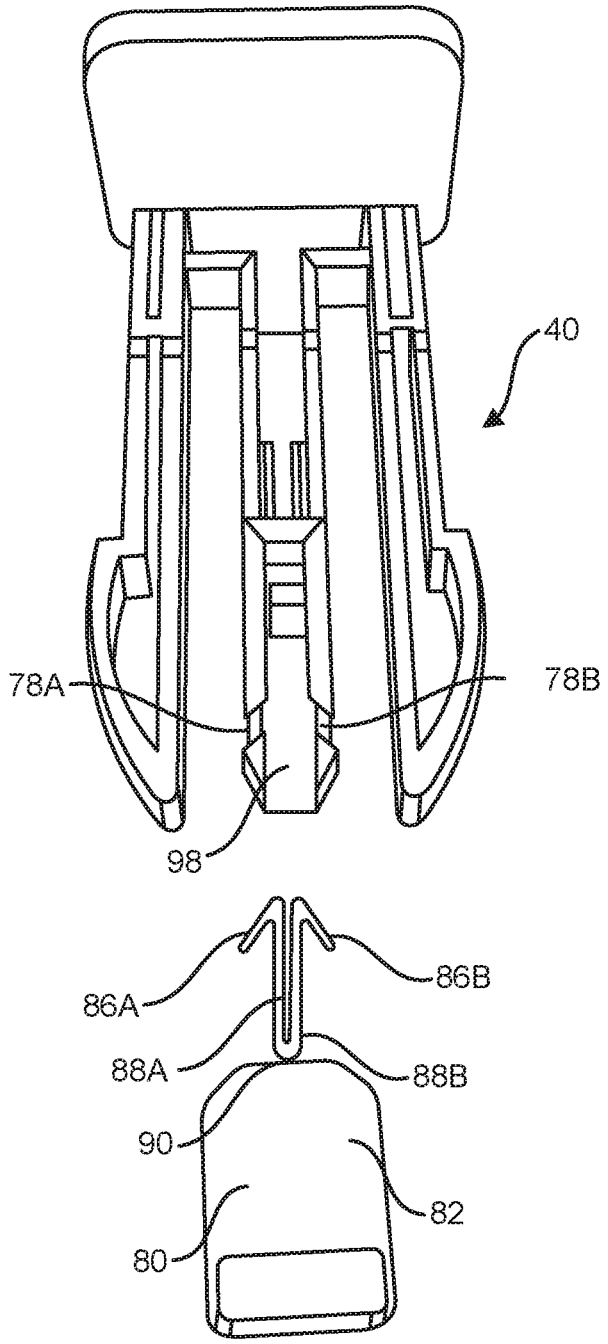
FIG. 15A illustrates an exemplary latch and an exemplary tamper-evident tag.
Figure 15B:
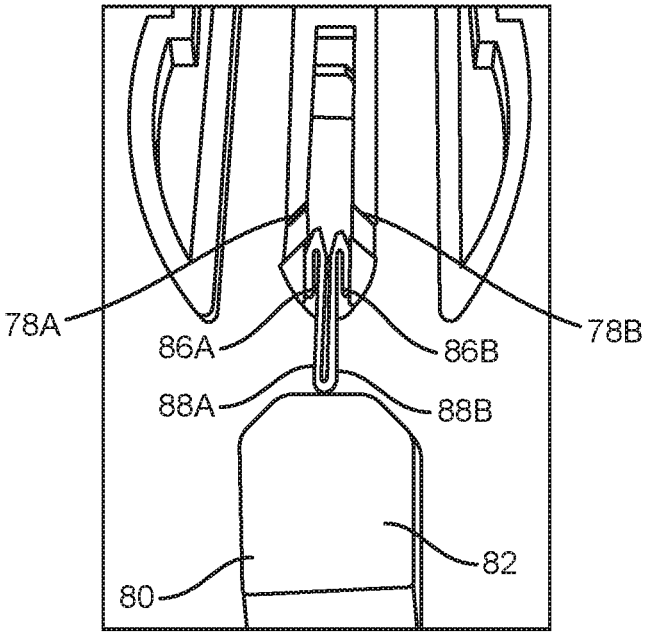
FIG. 15B illustrates the tamper-evident tag of FIG. 15A partially inserted into the latch.
Figure 15C:
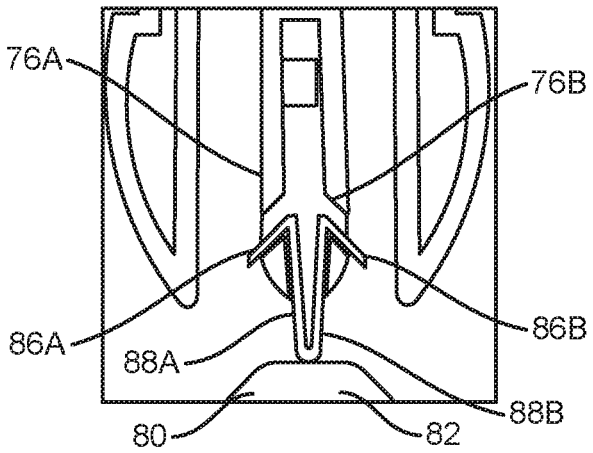
FIG. 15C illustrates the tamper-evident tag of FIG. 15A fully inserted into the latch.

Referring next to FIGS. 15A-15C, when a tamper-evident tag 80, such as tags 80A-80F (see FIGS. 10 and 11A-11F), is inserted through aperture 90 (see FIG. 14) into channel 98, the one or more resilient projections 86A, 86B are forced towards shaft members 88A, 88B to allow the insertion portion 84 to be inserted into aperture 90 and aligned channel 98. Once the resilient projections 86A, 86B have been inserted past the channel 98, the projections 86A, 86B resiliently flex back away from shaft members 88A, 88B and partially file the slots 78A, 78B. The tamper-evident tag 80 is then secured to latch 40 and container 10. To remove the tag 80, a user applies a sufficient force to grasping portion 82 to break tag 80 at breaking point 90. The projections 86A, 86B are then retained in corresponding slots 78A, 78B of latch 40 while the remainder of tag 80 attached to grasping portion 82 is removed. The latch 40 can then be opened by depressing one or more resilient portion 48 of latch 40 and moving latch 40 into the unsecured mode (see FIG. 4). In some exemplary embodiments, slots 78A, 78B of latch 40 is accessible to a user when latch 40 is in the unsecured mode such that the broken-off projections 86A, 86B may be removed from opening 96. A user may then move the latch 40 back to the secured position (see FIG. 6) and insert a new tamper-evident tag 80 into aperture 92.

In one exemplary embodiment illustrated in FIGS. 12 and 13, latch 40 includes a slot 94 for receiving a tamper-evident tag 80 through an aperture 92 in lower receiver 22 or upper receiver 32 (see FIG. 9) positioned on central member 52. Slot 94 is open to opening 96. When a tamper-evident tag 80, such as tag 80G or 80H (see FIGS. 11G-11J), is inserted through aperture 92, the one or more resilient projections 86 are forced towards shaft 88 to allow the insertion portion 84 to be inserted into aperture 92 and aligned slot 94. Once the resilient projections 86 have been inserted past the slot 94, the projections 86 resiliently flex back away from shaft 88 and partially file the opening 96. The tamper-evident tag 80 is then secured to latch 40 and container 10. To remove the tag 80, a user applies a sufficient force to grasping portion 82 to break tag 80 at breaking point 90. The projections 86 are then retained in opening 96 of latch 40 while the remainder of tag 80 attached to grasping portion 82 is removed. The latch 40 can then be opened by depressing one or more resilient portion 48 of latch 40 and moving latch 40 into the unsecured mode (see FIG. 4). In some exemplary embodiments, opening 96 of latch 40 is accessible to a user when latch 40 is in the unsecured mode such that the broken-off projections 86 may be removed from opening 96. A user may then move the latch 40 back to the secured position (see FIG. 6) and insert a new tamper-evident tag 80 into aperture 92.

Although FIGS. 12 and 13 illustrate slots 78A, 78B, and 94 for receiving projections 86 of tag 80 as being positioned on central member 52, in other exemplary embodiments, slot 78A, slot 78B, and/or slot 94 is positioned on body 42, upper portion 44, or a resilient portion 48 of latch 40. Moreover, although FIGS. 12 and 13 illustrate latch 40 as including both slot 78A and slot 78B for receiving a tamper-evident tag 80 through an aperture 90 in lower shelf 24 and a slot 94 for receiving a tamper-evident tag 80 through an aperture 92 in lower receiver 22 or upper receiver 32, in some embodiments, latch 40 may include only one of slot 78A, slot 78B, and slot 94.

Any of the techniques, improvements, features, functions, or processes described herein may be implemented in the form of a system or a kit. The system or kit may include any combination of the devices, components, elements, and/or modules disclosed herein.

The elements, components, and steps described herein are meant to exemplify some types of possibilities. In no way should the aforementioned examples limit the scope of the invention, as they are only exemplary embodiments.

The phrases "in some embodiments," "in an exemplary embodiment," "in one exemplary embodiment," "in some exemplary embodiments," "according to some embodiments," "in the embodiments shown," "in other embodiments," "in some examples," "in other examples," "in some cases," "in some situations," "in one configuration," "in another configuration," and the like generally mean that the particular technique, feature, structure, or characteristic following the phrase is included in at least one embodiment of the present invention and/or may be included in more than one embodiment of the present invention. In addition, such phrases do not necessarily refer to the same embodiments or to different embodiments.

The foregoing disclosure has been presented for purposes of illustration and description. Other modifications and variations of the disclosed techniques may be possible in view of the above teachings. The embodiments described in the foregoing disclosure were chosen to explain the principles of the concept and its practical application to enable others skilled in the art to best utilize the invention. It is intended that the claims be construed to include other alternative embodiments of the invention, except as limited by the prior art.

What is claimed is:

1. A storage container comprising:

a base having an interior storage volume;

a lid configured to close the interior storage volume of the base when the lid is placed in a closed position on the base; and a latch configured to move between an unsecured position in which the lid is movable from the closed position and a secured position in which the lid is retained in the closed position on the base by the latch, wherein the latch is configured to at least partially extend through an aperture having both a lid portion and a base portion, wherein the latch comprises:

an extended edge positioned at a first end of the latch, the extended edge configured to engage the lid to prevent the latch from passing entirely through the lid portion of the aperture, wherein the latch is captured by the lid and floats within the lid portion of the aperture when the latch is in the unsecured position; and a resilient portion positioned at a second end of the latch opposite the first end, the resilient portion configured to engage an opening in the base portion of the aperture to selectively retain the lid and the body in the closed position when the latch is in the secured position, wherein the latch is not permanently attached to either the base or to the lid.

2. The storage container of claim 1 wherein the latch further comprises a second resilient portion at the second end of the latch, the second resilient portion also configured to engage the base to selectively retain the lid in the closed position on the body by engaging a second opening in the base portion of the aperture.

3. The storage container of claim 1 wherein the latch further comprises a tab which interfaces with a retention feature of the lid such that the latch floats and remains captured by the lid when the latch is in the unsecured position, wherein the tab is configured to deflect when an external force is applied to the tab such that the tab bypasses the retention feature permitting the latch to be removed from the lid.

4. A portable storage container comprising:

a base including one or more sides, at least one of the one or more sides including a lower receiver;

a lid, wherein the base and the lid define an interior configured to store one or more items, and wherein the lid includes an upper receiver; and a latch for releasably securing the base to the lid, the latch including:

one or more resilient tabs each configured to be at least partially positioned within the upper receiver when the latch is in a first unsecured position and configured to releasably engage a corresponding engaging portion of the lower receiver when the latch is in a second secured position; and a secondary tab formed from a resilient material, the secondary tab configured to provide a biasing force when the latch is in the first unsecured position to engage the lid thereby retaining the latch in a floating position in the portable storage container when the latch is in the first unsecured position.

5. The portable storage container of claim 4, wherein each of the one or more resilient tabs is configured to be received within a corresponding opening of the lower receiver when the tab is in the second secured position, the engaging portions of the lower receiver each forming an edge of the corresponding opening.

6. The portable storage container of claim 4 further comprising a lower shelf connecting a lower end of the lower receiver to the base.

7. The portable storage container of claim 4 wherein the one or more resilient tabs of the latch include a first resilient tab and a second resilient tab, and wherein the secondary tab is formed on a central tab positioned between the first resilient tab and the second resilient tab.

8. The portable storage container of claim 7 wherein the secondary tab is configured to engage a stop recess in the upper receiver to maintain the latch in the first unsecured position.

9. The portable storage container of claim 4 wherein the latch includes an upper portion configured to extend beyond the upper receiver of the lid when the latch is in the first unsecured position and to contact a portion of the upper receiver when the latch is in the second secured position.

10. The portable storage container of claim 9 wherein the upper portion of the latch has an area greater than an area of a corresponding aperture in the upper receiver of the lid.

11. The portable storage container of claim 4 wherein the portable storage container is an insulated container and the base and the lid each include one or more thermally insulating elements.

12. The portable storage container of claim 4 further comprising a tamper-evident tag including a head and a body, the body including one or more resilient projections configured to be received within the latch.

13. The portable storage container of claim 4 wherein the lid is attached to base with a compound hinge including a first rod attached to the base and defining a first axis of rotation and a second rod attached to the lid and defining a second axis of rotation.

14. The portable storage container of claim 13 wherein the base includes a first receiver configured to receive the first rod, the first rod configured to be detachable from the first receiver to allow the lid to completely disconnect from the base.

15. The portable storage container of claim 14 wherein the lid includes a second receiver configured to receive the second rod, the second rod configured to be detachable from the second receiver to allow the lid to completely disconnect from the base.

16. A storage container comprising:

a base having an interior storage volume;

a lid configured to impermanently close the interior storage volume of the base when the lid is configured in a closed position on the base; and a latch configured to move between a first unsecured position in which the lid is movable from the closed position and a second secured position in which the lid is retained in the closed position on the base, the latch configured to at least partially extend through an aperture that extends through the lid and the base, the latch comprising:

an outer edge positioned at a first end of the latch, the outer edge configured to engage one of the lid and the base to prevent the latch from passing entirely through the aperture, wherein the latch floats and remains captured in the aperture of the one of the lid and the base when the latch is in the first unsecured position; and a resilient portion positioned at a second end of the latch opposite the first end, the resilient portion configured to engage the other of the lid and the base to selectively retain the lid and the body in the closed position when the latch is in the second secured position, wherein the latch is not permanently attached to the base or to the lid.

17. The storage container of claim 16 wherein the resilient portion of the latch engages an opening in the aperture of the other of the lid and the base to impermanently retain the lid in the closed position on the body when the latch is transitioned to the second secured position.

18. The storage container of claim 17 wherein the latch further comprises a second resilient portion at the second end of the latch, the second resilient portion configured to engage the other of the lid and the base to selectively retain the lid in the closed position on the body by engaging a second opening in the aperture of the other of the lid and the base.

19. The storage container of claim 18 wherein the first and second resilient portions of the latch are configured to flex in opposite directions to engage the first and second openings, respectively.

20. The storage container of claim 16 further comprising a tamper evident tag, a portion of the tamper evident tag configured to be received within the latch to attach the tamper evident tag to the latch, wherein the attached tamper evident tag is configured to break or deform in order for the latch to be transitioned from the second secured position to the first unsecured position.

21. The storage container of claim 16 wherein the latch is positioned on a first side of the lid, the storage container further comprising a hinge connecting a second side of the lid to the base, the second side being opposite the first side.

22. The storage container of claim 21 wherein the hinge is a compound hinge.

23. The storage container of claim 16 wherein the latch further comprises a tab which interfaces with a feature of the one of the lid and the base such that the latch floats and remains captured in the aperture of the one of the lid and the base when the latch is in the first unsecured position, the tab configured to deflect when an external force is applied such that the tab bypasses the feature permitting the latch to be removed from the one of the lid and the base.

* * * * *